US007144672B2

(12) United States Patent
Okano

(10) Patent No.: US 7,144,672 B2
(45) **Date of Patent: *Dec. 5, 2006**

(54) IMAGE FORMING METHOD BY USING THERMAL DYE TRANSFER SYSTEM

(76) Inventor: Satoshi Okano, c/o Konica Minolta Photo Imaging, Inc. 1, Sakura-machi, Hino-shi, Tokyo, 191-8511 (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/107,053

(22) Filed: Apr. 15, 2005

(65) Prior Publication Data

US 2005/0239648 A1 Oct. 27, 2005

(30) Foreign Application Priority Data

Apr. 27, 2004 (JP) ..... 2004-131287

(51) Int. Cl.
*B41M 5/40* (2006.01)
*G03C 8/10* (2006.01)
*G03C 8/26* (2006.01)

(52) U.S. Cl. ..... 430/201; 428/39.39; 503/227

(58) Field of Classification Search ..... 430/201; 503/227; 428/32.39

See application file for complete search history.

(56) References Cited

U.S. PATENT DOCUMENTS 4,987,049 A * 1/1991 Komamura et al. ..... 430/203
5,246,910 A * 9/1993 Koshizuka et al. ..... 503/227
5,358,922 A 10/1994 Nakayama et al.
5,457,082 A * 10/1995 Simpson et al. ..... 503/227
5,512,531 A 4/1996 Miura et al.
5,814,580 A * 9/1998 Onishi et al. ..... 503/227
5,837,649 A * 11/1998 Nozaki ..... 503/227
6,043,192 A 3/2000 Fukumuro et al.
2005/0059550 A1* 3/2005 Foster et al. ..... 503/227
2005/0059551 A1* 3/2005 Foster et al. ..... 503/227
2005/0067090 A1* 3/2005 Nakayama et al. ..... 156/235
2005/0192181 A1* 9/2005 Ikemizu et al. ..... 503/227
2005/0233901 A1* 10/2005 Nakane et al. ..... 503/201

FOREIGN PATENT DOCUMENTS

EP 0 618 081 10/1994

* cited by examiner

*Primary Examiner*—Richard L. Schilling

(57) ABSTRACT

An image forming method using thermal transfer ink sheet containing a thermally diffusible dye and an image receiving sheet containing a metal ion containing compound capable of forming a metal chelate compound with the dye, comprising superimposing the ink sheet and the image receiving sheet and imagewise heating the ink sheet to transfer the dye to the image receiving sheet, wherein the imagewise heating is performed at a print rate of not more than 1.5 msec/line, and the image receiving layer further contains a metal ion species or at least one of a sorbitan fatty acid ester, a sorbitan fatty acid ester having a polyoxyethylene group, a phosphoric acid ester and compounds of the following formulas $$HO—[CH_2CH_2O]_n—[CH_2CH(CH_3)O]_m—H$$

$$HO—(W—O)_p—H.$$

14 Claims, 3 Drawing Sheets

FIG. 2 ( a )
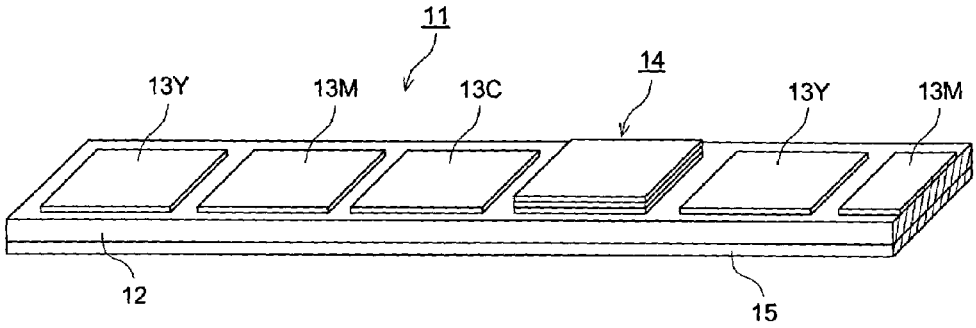
FIG. 2 ( b )
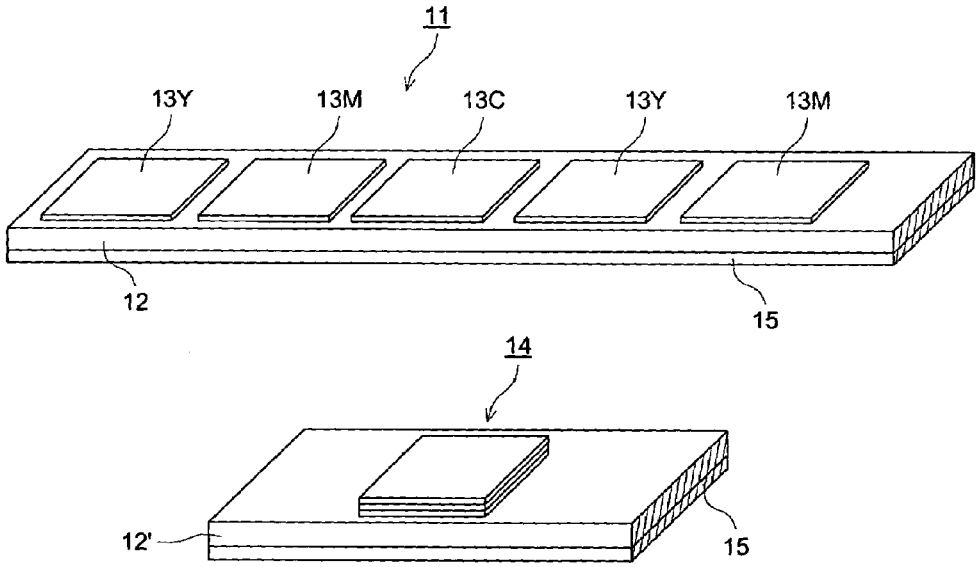

IMAGE FORMING METHOD BY USING THERMAL DYE TRANSFER SYSTEM

This application claims priority from Japanese Patent Application No. JP2004-131287 filed on Apr. 27, 2004, which is incorporated hereinto by reference.

FIELD OF THE INVENTION

The present invention relates to a novel image forming method employing a thermal dye transfer system.

BACKGROUND OF THE INVENTION

There have been known color or monochromatic imaging technologies in which an ink containing a thermally diffusible dye capable of diffusion transfer upon heating, is placed to face the dye receiving layer of an image receiving sheet, after which the thermally diffusible dye is allowed to be imagewise transferred to the dye receiving layer by heat-printing means such as thermal heads or lasers to form an image (employing a so-called thermal dye transfer system). Such a thermal transfer system enables one to achieve image formation using digital data without using processing solutions such as a developer solution. This thermal transfer system is recognized as a method for forming high quality images equal to those of silver salt photography.

There have been proposed various thermal dye transfer methods. Of these, a method of forming various types of full color images has been proposed, in which using a thermal transfer sheet having a sublimation type dye provided on a substrate sheet, the sublimation dye is transferred to a receiving material capable of being colored by the dye, that is, a so-called thermal transfer image receiving sheet having a dye receiving layer which is formed on paper, plastic film or the like. In that case, the thermal head of a printer is used as a heating means and three or four color dots are transferred to the thermal transfer image receiving sheet through heating over an extremely short period, while controlling the heating amount, and the thus multicolor dots can reproduce the full color of a manuscript.

The thus formed image is extremely clear and exhibits superior transparency and is also superior in reproduction or gradation of intermediate colors, whereby image quality equivalent to that of images obtained in conventional off-set printing or gravure printing can be achieved, enabling formation of high quality images equal to full color photographic images.

However, the thus obtained images were proved to have shortcomings such that the image storage stability or fastness was inferior to conventional silver salt photography.

Specifically, the following matters are cited:

(1) image fading or bleeding is caused by light or heat, aerial oxygen, or moisture during storage over a long period of time (light stability and heat stability), (2) when brought into contact with substances exhibiting relative high dying affinity, such as a photoalbum or clear file, or plastic erasers, or plasticizer-containing materials, dyes are reversely transferred or images bleed out (plasticizer resistance), (3) when water, juice, wine or coffee is dropped onto formed images and is wiped therefrom, dissolved dyes are also wiped off (water resistance and solvent resistance), (4) when touched with a finger, the touched portion is discolored due to sebum (sebum resistance), (5) when rubbed with eraser, image portions are removed (abrasion resistance), and (6) when converted by using commercially available laminating material, specifically, cold laminate material convertible at a relative low temperature, dyes diffuse into the laminating material, causing bleeding of images (laminate suitability).

Dyes used in conventional silver halide photography are protected with high boiling solvents or ultraviolet absorbents. On the contrary, dyes used in thermal transfer recording material are mainly dispersed in a binder and tend to be directly influenced by an external environment.

There were proposed, as a means for improving the foregoing disadvantages, image forming methods by employing so-called reactive dyes in which a compound contained in the dye layer is allowed to react with a compound in the dye receiving layer through thermal transfer. Herein, when the compound contained in the dye layer and the compound in the dye receiving layer are defined as a dye precursor and a dye fixer, respectively, and JP-A No. 9-327976 (hereinafter, the term, JP-A refers to Japanese Patent Application Publication), U.S. Pat. Nos. 4,880,769 and 5,534,479, for example, proposed that using a deprotonated cationic dye as a dye precursor and an organic polymer or oligomer capable of protonating the cationic dye as a dye fixer, the cationic dye wwes protonated again to achieve image formation. JP-A No. 5-221151 proposed an image forming method in which a reactive group containing a dye with a specific structure as a dye precursor and an active hydrogen compound as a dye fixer are used to perform thermal transfer to form an image.

There was proposed a thermal transfer image receiving sheet including a metal ion containing compound (also called a metal source) capable of forming a chelate upon reaction with a thermally diffusible dye which is chelatable with a metal, as disclosed in JP-A Nos. 10-129126 and 5-4460. Further, a post-chelate sublimation imaging method using a post-chelate type thermally diffusible dye capable of forming a chelate with a metal was also disclosed, for example, in JP-A Nos. 5-301470, 5-177958 and 5-312582, resulting in greatly enhanced image lasting quality, as compared to conventional sublimation images.

Recently, a technique for enhancing print speed (high-speed printing) to shorten the print-out time per sheet has been desired in the foregoing imaging method using thermal dye transfer. In response to such a demand, various studies have been made not only in thermal transfer ink sheet but also in thermal transfer image receiving sheets. There have also been made various attempts for enhancing the print speed in thermal transfer ink sheets and thermal transfer image receiving sheets of post chelate sublimation images exhibiting superior image lasting quality. However, it was proved that enhancing the print speed caused lowering in maximum density or deteriorated light fastness. Therefore, no method which concurrently satisfies enhancement of the print efficiency by shortening the print time and image characteristics (e.g., image density, light fastness) has been discovered under present conditions.

Further, it is contemplated to adopt a method of increasing the dye content of a thermal transfer ink sheet or performing the thermal transfer at relatively high energy to obtain sufficient image densities in the high-speed print. However, increasing the dye content of a thermal transfer ink sheet produced problems that bleed-out of the dye resulted after storage over a long period, resulting in staining of a thermal head and shortening the lifetime of the thermal head. Thermal transfer at relatively high energy often causes fusion between the ink sheet and the image receiving sheet at the time of thermal transfer, resulting in abnormal transfer.

SUMMARY OF THE INVENTION

The present invention has come into being in light of the foregoing problems. Thus, it is an object of the invention to provide an image forming method exhibiting high-speed print suitability and superior print efficiency, while maintaining a high print density and sufficient light fastness.

The foregoing object can be accomplished by the following constitution.

Thus, in one aspect the invention is directed to an image forming method by using a thermal transfer ink sheet comprising on a substrate sheet an ink layer containing a thermally diffusible dye capable of forming a chelate with a metal and a thermal transfer image receiving sheet comprising on a substrate a dye receiving layer containing a metal ion containing compound capable of forming a metal chelate compound upon reaction with the thermally diffusible dye, the method comprising the steps of (a) superimposing the ink layer onto the dye receiving layer and (b) imagewise heating the ink sheet based on a recording signal to transfer the thermally diffusible dye of the ink sheet to the image receiving sheet to thereby form an image, wherein the imagewise heating is performed at a print rate of not more than 1.5 msec/line, and the image receiving sheet further contains a metal ion species which is different from the metal ion containing compound or at least one of a sorbitan fatty acid ester, a sorbitan fatty acid ester having a polyoxyethylene group, a phosphoric acid ester compound, a compound represented by the following formula (1) and a compound represented by the following formula (2):

$$HO—[CH_2CH_2O]_n—[CH_2CH(CH_3)O]_m H \quad \text{formula (1)}$$

wherein n is an integer of 100 to 200; m is an integer of 10 to 50;

$$HO—(W—O)_p—H \quad \text{formula (2)}$$

wherein W is $—CH_2CH_2—$, $—CH_2CH_2CH_2—$, $—CH_2CH(CH_3)—$ or $—CH_2CH_2CH_2CH_2—$; and p is an integer of 5 to 50.

BRIEF EXPLANATION OF THE DRAWINGS

FIGS. 2(*a*) and 2(*b*) are each a perspective view of a thermal transfer ink sheet usable in the invention.

DETAILED DESCRIPTION OF THE INVENTION

A thermal transfer recording material comprises a thermal transfer ink sheet having on a substrate sheet an ink layer containing a thermally diffusible dye capable of forming a chelate with a metal and a thermal transfer image receiving sheet having on a substrate a dye receiving layer containing a metal ion containing compound capable of forming a metal chelate compound upon reaction with the thermally diffusible dye. In the image forming method of the invention, a thermal transfer ink sheet comprising on a substrate sheet an ink layer containing a thermally diffusible dye capable of forming a chelate with a metal and a thermal transfer image receiving sheet comprising on a substrate a dye receiving layer containing a metal ion containing compound which is capable of forming a metal chelate compound upon reaction with the thermally diffusible dye.

Figure 1:
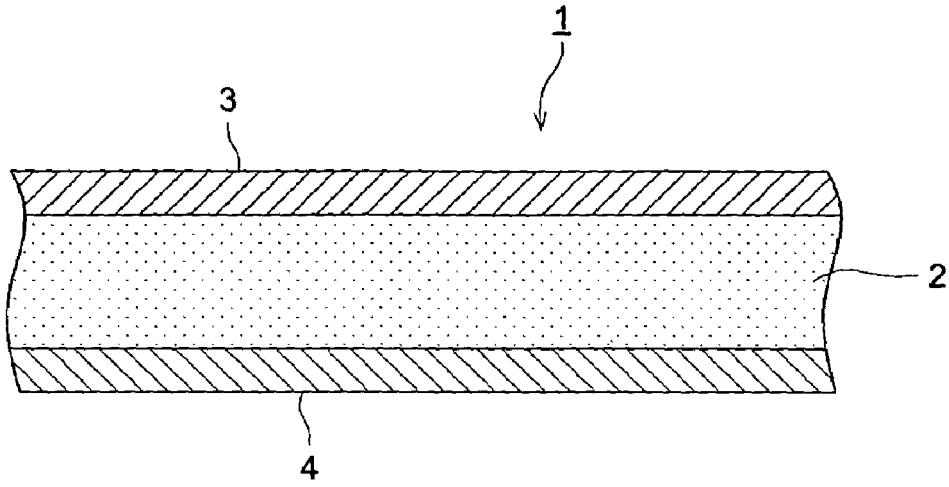
FIGS. 1(*a*) and 1(*b*) are sectional views of a thermal transfer ink sheet and thermal transfer image receiving sheet usable in the invention, respectively.
Figure 1:
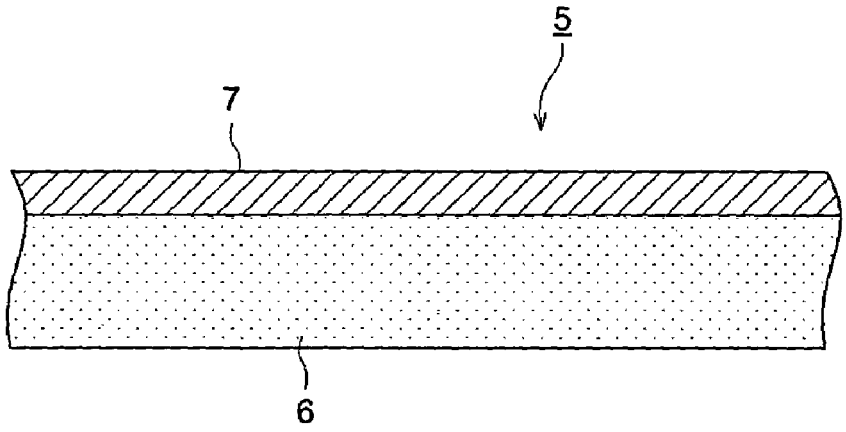

FIG. 1(*a*) and FIG. 1(*b*) illustrate sectional views of a thermal transfer ink sheet and a thermal transfer image receiving sheet, respectively, which constitute a thermal transfer recording material relating to this invention.

Specifically, FIG. 1(*a*) is a sectional view of showing typical constitution of a thermal transfer ink sheet. Thermal transfer sheet (1) has ink layer (3) on one side of substrate sheet (2) and heat-resistant slip layer (4) on the other side of the substrate sheet (2). FIG. 1(*b*) a sectional view of showing typical constitution of a thermal transfer image receiving sheet. Thermal transfer image receiving sheet (5) has dye receiving layer (7) on one side of substrate sheet (6).

Thermal Transfer Image Receiving Sheet

First, there will be described a thermal transfer image receiving sheet

The thermal transfer image receiving sheet (hereinafter, also denoted simply as image receiving sheet) of this invention is characterized in that the image receiving sheet contains, together with a metal ion containing compound which is capable of forming a metal chelate compound upon reaction with the thermally diffusible dye capable of forming a chelate, at least one metal species which is different from the metal ion containing compound.

Next, there will be described a metal ion containing compound (also denoted as a metal source) which is capable of forming a metal chelate compound upon reaction with thermally diffusible dye capable of forming a chelate.

Examples of a metal source include inorganic or organic salts or complexes of metal ions, and organic metal complexes are preferred. Metals include mono-valent or polyvalent metals selected from groups I–VIII of the periodical table, and specifically, Al, Co, Cr, Cu, Fe, Mg, Mn, Mo, Ni, Sn, Ti and Zn are preferred and Ni, Cu, Cr, Co and Zn are more preferred.

The metal ion containing compound capable of forming a metal chelate upon reaction with a thermally diffusible dye capable of forming a chelate is preferably a complex represented by the following formula (A). A complex represented by the following formula (A), which can be stably incorporated into the dye receiving layer and which is substantially colorless, is specifically preferred:

$$[M(Q_1)_x(Q_2)_y(Q_3)_z]^{p+}(L^-)_p \quad \text{formula (A)}$$

wherein M is a metal ion and, $Ni^{+2}$, $Cu^{+2}$, $Cr^{+2}$, $Co^{+2}$ or $Zn^{+2}$; $Q_1$, $Q_2$ and $Q_3$ are each a compound capable of forming a coordination bond with the metal ion of M (hereinafter, also denoted as a ligand compound), which may be the same or different and such a ligand compound can be selected from ligand compounds described, for example, in "Chelate Kagaku (5)" [Chelate Science (5), published by Nankodo]; $L^-$ is an organic anion such as tetraphenylborate anion or alkylbenzenesulfonate anion; x is an integer of 1, 2 or 3, y is an integer of 0, 1 or 2, and z is an integer of 0 or 1 and these x, y and z, depending on a complex of the foregoing formula being four-coordinate or six-coordinate, are determined by the number of ligands of $Q_1$, $Q_2$ and $Q_3$; p is an integer of 1 or 2. Specific examples of such a metal source include those described in U.S. Pat. No. 4,987,049 and compound 1 to 51 described in JP-A No. 10-67181.

A metal source is preferably contained in an amount of 5% to 80% by weight (more preferably 10% to 70%), based on the weight of a binder contained in the dye receiving layer. The metal source content is usually 0.5 to 20 g/m$^2$, and preferably 1 to 15 g/m$^2$.

The thermal transfer image receiving sheet used in the invention includes a metal ion species which is different from the foregoing metal ion containing compound. The metal ion species preferably is an organic metal compound, and more preferably, a metal salt of an organic acid (or an organic acid metal salt), a metal alcoholate (also called a metal alkoxide) or an organic metal complex having at least a coordination bond with an oxygen atom. Of organic acid metal salts, a fatty acid metal salt is more preferred, and an acetylacetonato-metal complex is preferred as an organic metal complex having at least a coordination bond with an oxygen atom.

Examples of a metal on species include alkaline earth metal(II) ions, $B^{3+}$, $Al^{3+}$, $Ga^{3+}$, $Zr^{4+}$, $Ag^{+}$, $Co^{2+}$, $CU^{2+}$, $Zn^{2+}$, and $Ni^{2+}$. Of these, a metal species selected from $Ni^{2+}$, $Cu^{2+}$, $Co^{2+}$, $Zn^{2+}$ and $Al^{3+}$ is preferred in terms of giving full play to effects of the invention.

When a metal species in the dye receiving layer is in the form of a metal salt of a fatty acid, the fatty acid preferably has 18 or fewer carbon atoms in terms of solubility in the dye receiving layer. A fatty acid having 8 or fewer carbon atoms may be a saturated fatty acid or an unsaturated fatty acid and the carbon chain may be straight, branched or cyclic.

Organic acids usable in this invention are those which contain a functional group such as a carboxylic acid, dicarboxylic acid, sulfonic acid and phenol and specific examples thereof include acetic acid, oxalic acid, tartaric acid, and benzoic acid.

Examples of a fatty acid having 18 or less carbon atoms include formic acid, acetic acid, propionic acid, butyric acid, valeric acid, caproic acid, enathic acid, caprylic acid, pelargonic acid, decanoic acid, undecylic acid, lauric acid, tridecylic acid, myristic acid, pentadecylic acid, palmitic acid, heptadecylic acid, stearic acid, acrylic acid, crotonic acid, isocrotonic acid, undecylenic acid, oleic acid, elaidic acid, sorbic acid, linolic acid, linolenic acid, propiolic acid and stearolic acid.

Although some commercially available metal salts have a metal content of about 10%, the content of a metal salt of an organic acid (or an organic acid metal salt), a metal alkoxide or an organic metal complex having at least a coordination bond with an oxygen atom refers to a content of effective metal salts which is calculated from a metal-content.

In the thermal transfer, the molar ratio of a metal ion contained in a metal ion containing compound to a metal ion contained in a metal ion species different from the metal ion containing compound is between 1.00:0.20 and 1.00:0.02. When the metal ion molar ratio of a metal ion containing compound to a metal ion species falls within the foregoing range, a superior print density can be maintained even when printed under high-speed conditions after storage over a long period and is less subject to ozone or moisture, leading to superior image lasting quality (lightfastness).

In one embodiment of the image forming method of the invention, the dye receiving layer contains at least one selected from a sorbitan fatty acid ester, a sorbitan fatty acid having a polyoxyethylene group, a phosphoric acid ester compound, a compound of the foregoing formula (1) and a compound of the foregoing formula (2).

Sorbitan fatty acid esters usable in this invention are not specifically limited, and lauric acid, palmitic acid, stearic acid, oleic acid and the like are usable as a fatty acid. Specific examples of such an ester include sorbitan monolaurate, sorbitan monopalmitate, sorbitan monostearate, sorbitan monooleate, sorbitan trioleate, sorbitan sesquioleate, and sorbitan distearate. Sorbitan fatty acid esters are commercially available and examples thereof include LEODOL SP-L10, SP-P10, SP-S10, SP-S30, SP-O10, SP-030, AS-10, AO-10 and AO-15; LEODOL SUPER SP-L10 and SP-S10; EMASOL L-10(F), P-10(F), S-10(F), O-10(F), O-30(F), O-15R and S-20; EMASOL SUPER L-10(F) and S-10(F) (which are available from Kao Corp.).

Sorbitan fatty acid ester having a polyoxyethylene group, usable in this invention are not specifically limited, and lauric acid, palmitic acid, stearic acid, oleic acid and the like are usable as a fatty acid. Specific examples of such an ester include polyoxyethylene sorbitan monolaurate, polyoxyethylene sorbitan monopalmitate, polyoxyethylene sorbitan monostearate, polyoxyethylene sorbitan monooleate, and polyoxyethylene sorbitan trioleate. Sorbitan fatty acid esters having a polyoxyethylene group are also commercially available and examples thereof include LEODOL TW-L120, TW-L106, TW-P120, TW-S120, TW-S106, TW-S320, TW-O120, TW-O106, and TW-0320; LEODOL SUPER TW-L120 and TW-S120TW-O120+ AMASOL O-105% (which are available from Kao Corp.).

Next, phosphoric acid ester compounds are described. Phosphoric acid esters are usable in this invention are not specifically limited and examples thereof include tributyl phosphate, trioctyl phosphate, tri-2-ethyhexyl phosphate, triphenyl phosphate, tricresyl phosphate, trixylenyl phosphate, cresyl diphenyl phosphate and 2-ethylhexyl diphenyl phosphate.

There will be describe a compound represented by formula (1):

$$HO—[CH_2CH_2O]_n—[CH_2CH(CH_3)O]_m—H \qquad \text{formula (1)}$$

wherein n is an integer of 100 to 200; m is an integer of 10 to 50. Specific examples are shown below but are not limited to these:

1-1 $HO—(CH_2CH_2O)_{150}—[CH_2CH(CH_3)O]_{30}—H$
1-2 $HO—(CH_2CH_2O)_{160}—[CH_2CH(CH_3)O]_{30}—H$
1-3 $HO—(CH_2CH_2O)_{120}—[CH_2CH(CH_3)O]_{30}—H$
1-4 $HO—(CH_2CH_2O)_{100}—[CH_2CH(CH_3)O]_{10}—H$
1-5 $HO—(CH_2CH_2O)_{100}—[CH_2CH(CH_3)O]_{15}—H$
1-6 $HO—(CH_2CH_2O)_{100}—[CH_2CH(CH_3)O]_{20}—H$
1-7 $HO—(CH_2CH_2O)_{150}—[CH_2CH(CH_3)O]_{20}—H$
1-8 $HO—(CH_2CH_2O)_{150}—[CH_2CH(CH_3)O]_{40}—H$
1-9 $HO—(CH_2CH_2O)_{200}—[CH_2CH(CH_3)O]_{30}—H$
1-10 $HO—(CH_2CH_2O)_{200}—[CH_2CH(CH_3)O]_{40}—H$
1-11 $HO—(CH_2CH_2O)_{200}—[CH_2CH(CH_3)O]_{50}—H$ next, compounds of formula (2) will be described:

$$HO—(W—O)_p—H \qquad \text{formula (2)}$$

wherein W is $—CH_2CH_2—$, $—CH_2CH_2CH_2—$, $—CH_2CH(CH_3)—$ or $—CH_2CH_2CH_2CH_2—$; and p is an integer of 5 to 50.

Compounds of formula (2) include, for example, polyethylene glycol, polypropylene glycol and polytetramethylene ether glycol, each of which includes compounds differing in polymerization degree. Examples thereof are as follows:

2-1: polyethylene glycol #400 (Av. MW 400)
2-2: polyethylene glycol #600 (Av. MW 600)

2-3: polyethylene glycol #1000 (Av. MW 1000)

2-4: polyethylene glycol #2000 (Av. MW 2000)

2-5: polypropylene glycol (Av. MW 400)

2-6: polypropylene glycol (Av. MW 700)

2-7: polypropylene glycol (Av. MW 1000)

2-8: polypropylene glycol (Av. MW 2000)

2-9: polytetramethyleneether glycol (Av. MW 700)

2-10: polytetramethyleneether glycol (Av. MW 1000)

Incorporation of a sorbitan fatty acid ester, a sorbitan fatty acid ester having a polyoxyethylene group, a phosphoric acid ester compound, a compound of the foregoing formula (1) or a compound of the foregoing formula (2) to the thermal transfer image receiving sheet can inhibit degradation of a chelated dye due to aerial oxygen or moisture. Even when imaging is conducted using a thermal transfer image receiving sheet which has been stored over a long-term, a sufficient image density can be obtained with no bleed-out of images even after aged under severe conditions, leading to sufficient light fastness.

The amount of a sorbitan fatty acid ester, a sorbitan fatty acid ester having a polyoxyethylene group, a phosphoric acid ester compound, a compound of the foregoing formula (1) or a compound of the foregoing formula (2) is not specifically limited but is generally from 0.01 to 5.0 g per $m^2$ of thermal transfer image receiving sheet, preferably from 0.05 to 2.0 g, and more preferably from 0.05 to 1.0 g.

The weight ratio of a sorbitan fatty acid ester, a sorbitan fatty acid ester having a polyoxyethylene group, a phosphoric acid ester compound, a compound of the foregoing formula (1) or a compound of the foregoing formula (2) to a binder resin is preferably between 0.50:1.00 and 0.04:1.00. When this weight ratio falls within the foregoing range, a superior print density can be maintained even when printed under high-speed conditions after storage over a long-term and is less subject to ozone or moisture, leading to superior image lasting quality (lightfastness), whereby superior high-speed print suitability and enhanced print efficiency can be achieved and superior image characteristics can be maintained.

Next, there will be described constituent elements of a thermal transfer image receiving sheet.

Substrate Sheet

A substrate sheet used in a thermal transfer image receiving sheet plays the role of supporting a dye receiving layer and heat is applied thereto at the time of thermal transfer, and it is therefore preferred to have mechanical strength at levels of causing no problem in handling, even when excessively heated.

Material for such a substrate is not specifically limited and examples thereof include condenser paper, glassine paper, sulfuric acid paper or high-sizing paper, synthetic paper (polyolefin type, polystyrene type), fine-quality paper, art paper, coat paper, cast coat paper, wallpaper, backing paper, synthetic resin- or emulsion-impregnated paper, synthetic rubber latex-impregnated paper, synthetic resin-incorporated paper, fiber board, cellulose fiber paper; films of polyester, polyacrylate, polycarbonate, polyurethane, polyimide, polyetherimide, cellulose derivatives, polyethylene, ethylene vinyl acetate copolymer, polypropylene, polystyrene, acryl, polyvinyl chloride, poluethylidene chloride, polyvinyl alcohol, polyvinyl butyral, nylon, polyether ether ketone, polysulfone, polyether sulfone, tetrafluoroethylene-ethylene, tetrafluoroethylene, hexafluoropropylene, poly chlorotrifluoroethylene and polyvinylidene fluoride; white opaque film obtained by adding a white pigment or a filler to the foregoing synthetic resins or blowing sheet.

There can also be employed laminated material using a combination of the foregoing substrates. A representative laminated material is, for example, laminate paper of cellulose fiber paper and synthetic paper and laminated paper of cellulose synthetic paper and plastic film. The foregoing substrate sheets may be at any reasonable thickness and preferably at 10 to 300 μm.

It is preferred to allow a layer containing fine voids, which results in high quality images without density unevenness or white spots, as well as further enhanced printing sensitivity. Plastic film or synthetic paper containing internal fine voids is usable as a layer containing fine voids (hereinafter, also denoted as fine-void containing layer). A plastic film or synthetic paper which is obtained by blending polyolefin, specifically containing polypropylene as a main component with inorganic pigments and/or a polymer immiscible with polypropylene as a void formation component, followed by film formation and stretching, is preferred as plastic film or synthetic paper containing fine voids. Plastic film or paper mainly composed of polyester is inferior in cushioning property and heat-insulating ability due to its viscoelastic and thermal properties, compared to one mainly composed of polypropylene, resulting in lowered printing sensitivity and density unevenness.

In view of the foregoing, a plastic film or synthetic paper preferably exhibits an elastic modulus of $5\times10^8$ to $1\times10^{10}$ Pa at 20° C. Film formation of the plastic film or synthetic paper is conducted with being biaxially stretched so that it readily shrinks on heating. When allowed to stand for 60 sec at 110° C., it exhibits a shrinkage factor of 0.5% to 2.5%. The plastic film or synthetic paper may be a single fine-void containing layer or composed of plural layers. In the case of being composed of plural layers, all of the layers may contain fine voids or there may be included a layer containing no void. There may be incorporated a white pigment as a shielding agent to the plastic film or synthetic paper. There may also be incorporated additives such as a brightener to enhance whiteness. The fine-void containing layer preferably has a thickness of 30 to 80 μm.

The fine-void containing layer can be formed by coating a layer containing fine voids on a substrate. Commonly known plastic resins such as polyester, urethane resin, polycarbonate, acryl resin, polyvinyl chloride, and polyvinyl acetate are usable alone or in a blend of them.

For the purpose of anti-curling, there may optionally be provided a layer of resins such as polyvinyl alcohol, polyvinylidene chloride, polyethylene, polypropylene, modified polyolefin, polyethylene terephthalate or polycarbonate, or a layer of synthetic paper on the side of the substrate opposite a dye receiving layer. Commonly known lamination methods are applicable, including, for example, dry lamination, non-solvent (hot melt) lamination, and EC lamination methods. Of these, dry lamination and non-solvent lamination methods are preferred. Adhesives suitable for the non-solvent lamination method include, for example, Takenate 720L, manufactured by Takeda Yakuhin Kogyo Co., Ltd. and adhesives suitable for the dry lamination method include, for example, Takelac A969/Takenate A-5(3/1), manufactured by Takeda Yakuhin Kogyo Co., Ltd., and polysol PSA SE-1400, Vinylol PSA AV-6200 series, manufactured by Showa Kobunshi Co., Ltd. Adhesives are used at a solid content of 1 to 8 g/m$^2$, preferably 2 to 6 g/m$^2$.

As described above, a plastic film and a plastic paper, each of them, or various paper and plastic film or paper can be laminated via an adhesion layer.

It is preferred to apply various primer treatments or a corona discharge treatment to the substrate surface to enhance adhesion strength between the substrate sheet and the dye receiving layer.

Binder Resin

Commonly known binder resins can be used in the thermal transfer image receiving sheet and ones which easily dye are preferably used. Specific examples thereof include a polyolefin resin such as polypropylene halogenated resin such as polyvinyl chloride or polyvinylidene chloride, vinyl type resin such as polyvinyl acetate or poly(acrylic acid ester), polyester resin such as polyethylene terephthalate or polybutylene terephthalate, polystyrene resin, polyamide resin, phenoxy resin, copolymer of olefins such as ethylene or propylene and other vinyl type resins, polyurethane, polycarbonate, acryl resin ionomer, cellulose derivatives, and a mixture of the foregoing resins. Of these, polyester type resin, polyvinyl type resin and cellulose derivatives are preferred.

Mold-releasing Agent

To prevent thermal fusing onto the dye layer, the dye receiving layer preferably incorporates a mold-releasing agent (hereinafter, also denoted simply as releasing agent). Mold-releasing agents usable in this invention include, for example, a phosphoric acid ester type plasticizer, fluorinated compounds and silicone oil (including reactive curing silicone), and of these, silicone oil is preferred. Dimethylsilicone and various modified silicones are usable as a silicone oil. Specific examples thereof include amino-modified silicone, urethane-modified silicone, alcohol-modified silicone, vinyl-modified silicone, urethane-modified silicone, which may be blended or polymerized by employing various reactions. Mold-releasing agents may be used alone or in a combination of them. A mold-releasing agent is added preferably in an amount of 0.5 to 30 parts by weight, based on 100 parts of binder resin used in the dye receiving layer. Addition falling outside the foregoing range often causes problems such as fusing of the thermal transfer sheet to the dye receiving layer of a thermal transfer image receiving sheet or lowering in printing sensitivity. Instead of incorporating a mold-releasing agent to a dye receiving layer, there may be separately provided a mold-releasing layer onto the dye receiving layer.

Interlayer

The thermal transfer sheet may be provided with an interlayer between the substrate sheet and a dye receiving layer. The interlayer refers to all layers existing between the substrate sheet and the dye receiving layer, which may also be multilayered. Functions of the interlayer include solvent resistance capability, barrier performance, adhesion performance, whitening capability, masking capability and antistatic capability. Any interlayer known in the art is applicable without being specifically limited.

In order to provide solvent resistance capability and a barrier performance to the interlayer, a water-soluble resin is preferably used. Specific examples of water-soluble resin include cellulose type resins such as carboxymethyl cellulose, polysaccharide type resins such as starch, proteins such as casein, gelatin, agar, vinyl type resins such as polyvinyl alcohol, ethylene vinyl acetate copolymer, polyvinyl acetate, polyvinyl chloride, vinyl acetate copolymer (e.g., BEOPA, manufactured by Japan Epoxy Resin Co., Ltd.), vinyl acetate (metha)acryl copolymer, (metha)acryl resin, styrene (metha) acryl copolymer and styrene resin; melamine resin, urea resin, polyamide type resin such as benzoguanamine resin, polyester and polyurethane. The water-soluble resin is one which is completely dissolved in an aqueous solvent mainly comprised of water (having a particle size of not more than 0.01 μm) or dispersed in the form of colloidal dispersion (having a particle size of 0.01 to 0.1 μm), emulsion (having a particle size of 0.1 to 1.0 μm) or a slurry (having a particle size of more than 1.0 μm). Of the foregoing resins, those which are not dissolved or not swelled in general-purpose solvents such as alcohols (e.g., methanol, ethanol, isopropyl alcohol), hexane, cyclohexane, acetone, methyl ethyl ketone, xylene, ethyl acetate, butyl acetate and toluene. In this sense, a resin which is completely dissolved in a solvent, mainly composed of water, is more preferred. Polyvinyl alcohol resin and cellulose resin are cited.

In order to provide adhesion capability to the interlayer, urethane resin or a polyolefin type resin is general used, depending on the kind of substrate sheet or the surface treatment thereof. The combined use of a thermoplastic resin containing an active hydrogen and a curing agent such as an isocyanate compound achieves superior adhesion properties. There are employed fluorescent brightening agents to provide whitening capability to the interlayer. Any compound known as a fluorescent brightening agent is usable and examples thereof include stilbene type, distilbene type, benzoxazole type, styryl-oxazole type, pyrane-oxazole type, coumalin type, aminocoumalin type, imidazole type, benzimidazole type, pyrazoline type and distyryl-biphenyl type brightening agents. Whiteness can be controlled by the kind and the content of the fluorescent brightening agent. Fluorescent brightening agents can be added by any means. Examples thereof include addition through solution in water, addition through pulverizing dispersion by using a ball mill or a colloid mill, a method of dissolving in a high boiling solvent, dispersing in a hydrophilic colloid solution and adding it in the form of oil-in-water type dispersion, and addition by impregnating with a polymer latex.

To conceal surface glare or unevenness of the substrate sheet, titanium oxide may be added to the interlayer. The use of titanium oxide, which expands freedom of choice of substrate sheets, is preferred. Titanium oxide includes two types, rutile type titanium oxide and anatase type titanium oxide. Taking into account whiteness and effects of a fluorescent brightener, the anatase type titanium oxide which exhibits ultraviolet absorption at shorter wavelengths than the rutile type one is preferred. In cases when a binder of the interlayer is an aqueous type and titanium oxide is difficult to be dispersed therein, titanium oxide which has been subjected to a hydrophilic surface treatment, may be used or commonly known dispersing agents such as surfactants or ethylene glycol may be used to perform dispersion. The content of titanium oxide is preferably from 10 to 400 parts by weight, based on 100 parts by weight of resin solids.

To provide the interlayer with an antistatic capability, electrically conductive material known in the art, such as a conductive inorganic filler or an organic conductive material, e.g., poly(anilinesulfonic acid) is optimally chosen so as to be compatible with the interlayer binder resin. It is preferred to have the interlayer thickness fall within the range of 0.1 to 10 μm.

Next, there will be described a thermal transfer ink sheet (also denoted as thermal transfer sheet or ink sheet).

Substrate Sheet

Material known as a substrate sheet of conventional thermal transfer ink sheet or thermal transfer sheet is also usable as a substrate sheet of a thermal transfer ink sheet of this invention. Specific examples of a preferred substrate sheet include thin paper such as glassine paper, condenser paper and paraffin paper, and stretched or unstretched plastic film of polyethylene terephthalate, polyethylene naphthalate, polybutylene terephthalate, polyphenylene sulfide, polyether ketone, highly heat-resistant polyester such as polyether sulfone, polypropylene, fluororesin, polycarbonate, cellulose acetate, polyethylene derivatives, polyvinyl chloride, polyvinilidene chloride, poystyrene, polyamide, polyimide, polymethylpentene, and ionomer, and laminated forms of the foregoing. The thickness of a substrate sheet, which is chosen in accordance with the material so as to optimize strength and heat resistance, is preferably from 1 to 100 μm.

The surface of a substrate sheet may be subjected to a primer treatment or a corona discharge treatment when adherence to the dye layer formed on the surface of a substrate sheet is poor.

Ink Layer and Dye

The dye layer constituting the ink sheet of this invention is a thermally sublimating colorant layer containing at least one dye and a binder. Dyes contained in the dye layer may be used singly or in combinations of them.

Next, dyes usable in this invention will be described. The dye including region used in the ink sheet may be a region including at least two dyes differing in color. For example, in one embodiment, the dye including region is comprised of a region including a yellow dye, a region including a magenta dye and a region including a cyan dye; in another embodiment, the dye including region is comprised of an ink layer including a black dye and next to the region, a region including no dye is formed; in another embodiment, the dye including region is comprised of a region including a yellow dye, a region including a magenta dye, a region including a cyan dye and a region including a black dye, and next to these regions, a region including no dye is formed.

Dyes usable in the thermally sublimating colorant layer include those used in ink sheets of a commonly known heat-sensitive sublimation thermal transfer system, such as azo type, azomethine type, methine type, anthraquinone type, quinophthalone type, and naphthoquinone type dyes. Specific examples yellow dyes such as phorone brilliant yellow 6GL and pTY-52, and macrolex yellow 6G; red dyes such as MS red G, macrolex red violet R, ceresred 7B, samarone red HBSL and SK rubin SEGL; and blue dyes such as cayaset blue 714, wacsoline blue, phorone brilliant blue S-R, MS blue 100 and dite blue No. 1.

Any thermally transferable dye is usable as a chelatable, thermally diffusible dye and various types of commonly known compounds may be optimally chosen and used. Examples thereof include cyan, magenta and yellow dyes described in JP-A Nos. 59-78893, 59-109349, 4-94974 and 4-07894 and U.S. Pat. No. 2,856,225.

Chelating cyan dyes include, for example, a compound represented by the following formula (1):

formula (1)

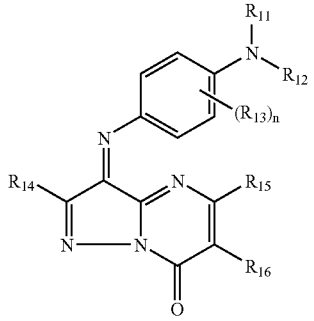

In the foregoing formula (1), $R_{11}$ and $R_{12}$ are each a substituted or unsubstituted aliphatic group and $R_{11}$ and $R_{12}$ may be the same or different. Examples of an aliphatic group include an alkyl group, cycloalkyl group, alkenyl group and alkynyl group. Examples of an alkyl group include methyl, ethyl, propyl and iso-propyl, and the alkyl group may be substituted by a substituent. Examples of the substituent include an alkyl group (e.g., methyl, ethyl, 1-propyl, t-butyl, n-dodecyl, 1-hexyl, nonyl), cycloalkyl group (e.g., cyclopropyl, cyclohexyl, bicyclo[2,2,1]heptyl, adamantly), alkenyl group (e.g., 2-propylene, oleyl), aryl group (e.g., phenyl o-tolyl, o-anisyl, 1-naphthyl, 9-anthranyl), heterocyclic group (e.g., 2-tetrahydrofuryl, 2-thiophenyl, 4-imidazolyl, 2-pyridyl), halogen atom (e.g., fluorine atom, chlorine atom, bromine atom, iodine atom), cyano group, nitro group, hydroxyl group, carbonyl group (e.g., alkylcarbonyl such as acetyl, trifluoroacetyl and pivaloyl; arylcarbonyl group such as benzoyl, pentafluorobenzoyl, 3,5-di-t-butyl-4-hydroxybenzoyl), oxycarbonyl group (e.g., alkoxycarbonyl such as methoxycarbonyl, cyclohexyloxycarbonyl and n-dodecyloxycarbonyl; aryloxycarbonyl such as phenoxycarbonyl, 2,4-di-t-amylphenoxycarbonyl and 1-naphthyloxycarbonyl; heterocyclic-oxycarbonyl such as 2-pyridyloxycarbonyl, 1-phenylpyrazolyl5-oxycarbonyl), carbamoyl group (e.g., alkylcarbamoyl such as dimethylcarbamoyl, 4-(2,4-di-t-amylphenoxy)butylaminocarbonyl; arylcarbamoyl such as phenylcarbamoyl and 1-naphthylcarbamoyl), alkoxy group (e.g., methoxy, 2-ethoxyethoxy), aryloxy group (e.g., phenoxy, 2,4 di-t-amylphenoxy, 4-(4-hydroxyphenylsulfonyl) phenoxy), heterocyclic-oxy group (e.g., 4-pyridyloxy, 2-hexahydropyranyloxy), carbonyloxy group (e.g., alkylcarbonyloxy such as acetyloxy, trifluoroacetyloxy, pivaloyloxy; arylcarbonyloxy such as benzoyloxy and pentafluorobenzoyloxy), urethane group (e.g., alkylurethane group such as N,N-dimethylurethane; arylurethane group such as N-phenylurethane and N-(p-cyanophenyl)urethane), sulfonyloxy group (e.g., alkylsulfonyloxy such as methanesulofonyloxy, trifluoromethanesulfonyloxy and n-dodecanesulfonyloxy; arylsulfonyloxy such as benzenesulfonyloxy and p-toluenesulfonyloxy), an amino group (e.g., alkylamino such as dimethylamino, cyclohexylamine and npdodecylamino; arylamino such as anilino and p-tpoctylanilino), sulfonylamino group (e.g., methanesulfonylamino, heptafluoropropanesulfonylamino and n-hexadecylsulfonylamino; arylsulfonylamino such as p-toluenesulfonylamino and pentafluorobenzenesulfonylamino), sulfamoylamino group (e.g., alkylsufamoylamino such as N,N-dimethylsulfamoylamino; arylsulfamoylamino such as N-phenylsulfamoylamino), acylamino group (e.g., alkylcarbonylamino such as acetylamino and myrystoylamino; arylcarbonylamino such as benzoylamino), ureido group (e.g., alkylureido such as N,N-dimethylureido; arylureido such as N-phenylureido and N-(p-cyanophenyl)ureido), sulfonyl group (e.g., alkylsulfonyl such as methanesulfonyl and trifluoromethasulfonyl; arylsulfonyl such as p-toluenesulfonyl), sulfamoyl group (e.g., alkysulfamoyl such as dimethylsulfamoyl, 4-(2,4-di-t-amylphenoxy)butylaminosulfonyl; arylsulfamoyl such as phenylsulfamoyl), alkylthio group (e.g., methylthio, t-octylthio), arylthio group (e.g., phenylthio), and heterocyclic-thio group (e.g., 1-phenyltetrazole-5-thio, 5-methyl-1,3,4-oxadiazole-2-thio).

Cycloalkyl and alkenyl groups may be substituted. Examples of a substituent are the same as defined in the foregoing. An alkynyl group include, for example, 1-propyne, 1-butyne and 1-hexyne.

As $R_{11}$ and $R_{12}$ are also preferred a group forming a non-aromatic cycle structure (e.g., pyrrolidine ring, piperazine ring, morpholine ring).

$R_{13}$ is a substituent as described above and preferably an alkyl group, cycloalkyl group, alkoxy group, or acylamino group, and n is an integer of 0 to 4, provided that when n is 2 or more, plural $R_{13}$s may be the same or different.

$R_{14}$ is an alkyl group such as methyl, ethyl, iso-propyl, t-butyl, n-dodecyl and 1-hexylnonyl. $R_{14}$ is preferably a secondary or tertiary alkyl group such as i-propyl, sec-butyl, t-butyl or 3-heptyl, and more preferably iso-propyl or t-butyl. The alkyl group of $R_{14}$ may be substituted by a substituent, provided that the substituent is comprised of carbon and hydrogen atoms and does not contain other atoms.

$R_{15}$ is an alkyl group such as n-propyl, i-propyl, t-butyl, n-dodecyl, or 1-hexylnonyl. $R_{15}$ is preferably secondary or tertiary alkyl group, such as i-propyl, sec-butyl, t-butyl or 3-heptyl; and more preferably I-propyl or t-butyl. The alkyl group of $R_{15}$ may be substituted by a substituent, provided that the substituent is comprised of carbon and hydrogen atoms and does not contain other atoms.

$R_{16}$ is an alkyl group such as n-propyl, n-butyl, n-pentyl, n-hexyl, n-heptyl, I-propyl, sec-butyl, t-butyl or 3-heptyl. $R_{16}$ is preferably a straight alkyl group having 3 or more carbon atoms, such as n-propyl, n-butyl, n-pentyl, n-hexyl or n-hexyl, and more preferably n-propyl or n-butyl. The alkyl group of $R_{16}$ may be substituted by a substituent, provided that the substituent is comprised of carbon and hydrogen atoms and does not contain other atoms.

Chelating yellow dyes include, for example, a compound represented by the following formula (2):

formula (2)

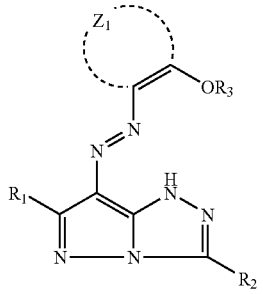

wherein $R_1$ and $R_2$ are each a substituent; $R_3$ is an alkyl group or aryl group; $Z_1$ is an atomic group necessary to form a 5- or 6-membered ring.

In the formula (2), Examples of a substituent represented by $R_1$ and $R_2$ include a halogen atom, an alkyl group (alkyl group having 1 to 12 carbon atoms, which may be substituted by a group interrupted with an oxygen atom, nitrogen atom, sulfur atom or carbonyl group, or substituted by an aryl group, alkenyl group, alkynyl group, hydroxy group, amino group, nitro group, carboxyl group, cyano group or a halogen atom; e.g., methyl, 1-propyl, t-butyl, trifluoromethyl, methoxymethyl, 2-methanesulfonylethyl, 2-methanesulfoneamidoethyl, cyclohexyl), aryl-group (e.g., phenyl, 4-t-butylphenyl, 3-nitrophenyl, 3-acylaminophenyl, 2 methoxyphenyl), cyano group, alkoxy group, aryloxy group, acylamino group, anilino group, ureido group, sulfamoyl group, alkylthio group, arylthio group, alkoxycarbonylamino group, sulfonamido group, carbamoyl group, sulfamoyl group, sulfonyl group, alkoxycarbonyl group, heterocyclic-oxy group, acyloxy group, carbamoyloxy group, silyloxy group, aryloxycarbonylamino group, imido group, heterocyclic-thio group, phosphonyl group and acyl group.

The alkyl and aryl group represented by $R_3$ are the same as those of $R_1$ and $R_2$. Examples of a 5- or 6-membered ring formed by $Z_1$ together with two carbon atoms include benzene, pyridine, pyrimidine, triazine, pyrazine, pyridazine, pyrrole, furan, thiophene, pyrazole, imidazole, triazole, oxazole, and thiazole. These rings may further condense with other aromatic rings to form a condensed ring. The foregoing rings may be substituted by a substituent and examples of such a substituent are the same as those described in $R_1$ and $R_2$.

Chelating magenta dyes include, for example, a compound represented by the following formula (3):

formula (3)

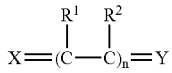

wherein X is a group or atom capable of forming a at least two dentate chelate; Y is an atomic group necessary to form a 5- or 6-membered aromatic hydrocarbon ring or heterocyclic ring; $R_1$ and $R_2$ are each a hydrogen atom, a halogen atom or a univalent substituent; n is 0, 1 or 2.

In the foregoing formula (3), X is preferably represented by the following formula (4):

formula (4)

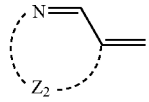

wherein $Z_2$ is an atomic group necessary to form an aromatic nitrogen-containing heterocyclic ring which is substituted by a chelatable, nitrogen-containing group. Examples of the ring include pyridine, pyrimidine, thiazole, and imidazole. The ring may further form a condensed ring together with other carbocyclic rings (e.g., benzene ring) and heterocyclic rings (e.g., pyridine ring).

In the foregoing formula (3), Y is an atomic group necessary to form a 5- or 6-membered aromatic hydrocarbon ring or heterocyclic ring, which may further be substituted or condensed. Specific examples of the ring include a 3H-pyrrole ring, oxazole ring, imidazole ring, thiazole ring, 3H-pyrrolidine ring, oxazolidine ring, imidazolidine ring, thiazolidine ring, 3H-indole ring, benzoxazole ring, benzimidazole ring, benzothiazole ring, quinoline ring and pyridine ring. The ring may further condense with other carbocyclic rings (e.g., benzene ring) or a heterocyclic ring (e.g., pyridine ring) to form a condensed ring. Substituents capable of being substituted onto the ring include, for example, an alkyl group, aryl group, heterocycle group, acyl group, amino group, nitro group, cyano group, acylamino group, alkoxy group, hydroxyl group, alkoxycarbonyl group and halogen atom. The foregoing groups may further be substituted. $R_1$ and $R_2$ are each a hydrogen atom, a halogen atom (e.g., fluorine atom, chlorine atom) or a univalent substituent (e.g., alkyl group, alkoxy group, cyano group, alkoxycarbonyl group, aryl group, heterocycle group, carbamoyl group, hydroxy group, acyl group, acylamino group). X is a group or atom capable of forming a at least two dendate chelate and include any one capable of forming a dye of formula (3), preferred examples thereof include 5-pyrazolone, imidazole, pyrazolopyrrole, pyrazolopyrazole, pyrazoloimidazole, pyrazolotetrazole, barbituric acid, thiobarbituric acid, rhodanine, hydantoin, thiohydantoin, oxazoline, isooxazolone, indanedione, pyrazolidinedione, oxazolidinedione, hydroxypyridone, and pyrazolopyridone.

Binder Resin

The dye layer relating to this invention contains a binder resin together with the foregoing dye. Any of binder resins used in conventional sublimation type thermal transfer ink sheet can be employed as a binder resin used for the dye layer. Examples of a binder resin include water-soluble polymers of a cellulose type, polyacrylic acid type, polyvinyl alcohol type and polyvinyl pyrrolidone type; and polymers soluble in an organic solvent, such as acryl resin, methacryl resin, polystyrene, polycarbonate, polysulfone, polyethersulfone, polyvinyl butyral, polyvinyl acetal, ethyl cellulose and nitrocellulose. Of these, polyvinyl butyral, polyvinyl acetal and cellulose type resin, which exhibit superior storage stability, are preferred.

The content of a dye or binder resin of the dye layer is not specifically limited and optimally set in terms of performance.

In addition to the foregoing dye and binder, the dye layer may contain various commonly known additives. The dye layer can be formed, for example, in such a manner that an ink coating solution, prepared by dissolving or dispersing a dye, binder resin and other additives is coated on a substrate sheet by known means such as a gravure coating method, followed by drying. The thickness of the dye layer is usually 0.1 to 3.0 μm, and preferably 0.3 to 1.5 μm.

Protective Layer

The ink sheet relating to this invention is preferably provided with a thermally transferable protective layer. The thermally transferable protective layer is comprised of a transparent resin layer which is transferred onto the image receiving layer to cover the surface of the formed image. Examples of resin to form a protective layer include polyester resin, polystyrene resin, acryl resin, polyurethane resin, acrylurethane resin, polycarbonate resin, and epoxy- or silicone-modified resins of the foregoing, a mixture of the resins described above, ionizing radiation-curing resin and ultraviolet shielding resin. Of these, polyester resin, polycarbonate resin, epoxy-modified resin and ionizing radiation-curing resin are preferred. As polyester resin is preferred alicyclic polyester resin in which diol and acid constituents are each composed of at least one alicyclic compound. Polycarbonate resin is preferably an aromatic polycarbonate resin and an aromatic polycarbonate resin described in JP-A No. 11-151867 is specifically preferred.

Examples of epoxy-modified resin include epoxy-modified polyethylene, epoxy-modified polyethylene terephthalate, epoxy-modified polyphenylsufite, epoxy-modified cellulose, epoxy-modified polypropylene, epoxy-modified polyvinyl chloride, epoxy-modified polycarbonate, epoxy-modified acryl, epoxy-modified polystyrene, epoxy-modified polycarbonate, epoxy-modified polymethylmethacrylate, epoxy-modified silicone, a copolymer of epoxy-modified polystyrene and epoxy-modified polymethylmethacrylate, a copolymer of epoxy-modified acryl and epoxy-modified polystyrene, and a copolymer of epoxy-modified acryl and epoxy-modified silicone. Of these, epoxy-modified acryl, epoxy-modified polystyrene, epoxy-modified polymethylmethacylate and epoxy-modified silicone are preferred, and a copolymer of epoxy-modified polystyrene and epoxy-modified polymethylmethacrylate, a copolymer of epoxy-modified acryl and epoxy-modified polystyrene, and a copolymer of epoxy-modified acryl and epoxy-modified silicone are more preferred.

Ionizing Radiation Curing Resin

Ionizing radiation curing resin is usable as a thermally transferable protective layer. Superior resistance to plasticizer or abrasion can be achieved by allowing a thermally transferable protective layer to contain such a resin. Commonly known ionizing radiation curing resins are usable. For example, a radical polymerizable polymer or oligomer is exposed to ionizing radiation to cause cross-linking or curing, or a photopolymerization initiator is optionally added and polymerization cross-linking is caused by an electron beam or ultraviolet rays.

Ultraviolet Ray Shielding Resin

The main object of a protective layer containing an ultraviolet ray shielding resin is to provide light resistance to printed material. For example, a resin obtained by allowing a reactive ultraviolet absorbent to react with or bind to a thermoplastic resin or the foregoing ionizing radiation curing resin is usable as a ultraviolet ray shielding resin. Specifically, there is exemplified introduction of a reactive group such as an addition-polymerizing double bond (e.g., vinyl group, acryloyl group, methacryloyl group), an alcoholic hydroxyl group, an amino group, a carboxyl group, epoxy group, and isocyanate group into non-reactive organic ultraviolet absorbents such as salicylate type, benzophenone type, benzotriazole type, substituted acrylonitrile, nickel chelate type, and hindered amine type.

The main protective layer provided in the foregoing thermally transferable protective layer of a single layer structure or multilayer structure usually forms a thickness of 0.5 to 10 μm, depending on the kind of resin used for the protective layer.

The thermally transferable protective layer is preferably provided via a non-transferable mold-releasing layer on a substrate sheet.

A non-transferable mold-releasing layer (which is hereinafter also denoted simply as releasing layer) preferably contains (1) inorganic microparticles having an average particle size of not more than 40 nm in an amount of 30% to 80% by weight together with a resin binder, (2) a copolymer of alkyl vinyl ether and anhydrous maleic acid, its derivative or its mixture in an amount of not less than 20%, or (3) an ionomer in an amount of not less than 20% by weight to maintain adhesion between a substrate sheet and a non-transferable releasing layer stronger than adhesion between the non-transferable releasing layer and a thermally transferable protective layer and to achieve adhesion between the non-transferable releasing layer and the thermally transferable protective layer after heat-applied stronger than that before heat-applied. A non-transferable releasing layer may optionally contain additives.

Examples of inorganic microparticles usable in this invention include particulate silica such as anhydrous silica or colloidal silica, and metal oxides such as tin oxide, zinc oxide and zinc antimonate. Inorganic microparticles preferably have a particle size of not more than 40 nm. A particle size of more than 40 nm increases unevenness of the surface of a thermally transferable protective layer due to unevenness of the surface of a releasing layer, resulting in an unsuitable lowering of transparency of the protective layer.

Resin binder to be mixed with inorganic microparticles is not specifically limited and any miscible resin is usable. Examples thereof include polyvinyl alcohol (PVA) resins with various saponification degrees, polyvinyl acetal resin, polyvinyl butyral resin, acryl type resin, polyamide resin, cellulose type resin such as cellulose acetate, alkyl cellulose, carboxymethyl cellulose or hydroxyalkyl cellulose, and polyvinyl pyrrolidone resin.

The compounding ratio of inorganic microparticles to other compounding components mainly comprised of resin binder (inorganic microparticles/other compounding components) is preferably not less than 30/70 and not more than 80/20 by weight. A compounding ratio of less than 30/70 results in insufficient effects of inorganic microparticles and a compounding ratio of more than 80/20 causes incomplete film formation of the releasing layer, forming a portion in which the substrate sheet is directly in contact with the protective layer.

As a copolymer of alkyl vinyl ether and anhydrous maleic acid or its derivative, for example, one in which an alkyl group of an alkyl vinyl ether portion is methyl or ethyl and one in which an anhydrous maleic acid portion partially or completely forms a half-ester with an alcohol (e.g., methanol, ethanol, propanol, isopropanol, butanol, isobutanol) are usable.

The releasing layer may be formed of a copolymer of alkyl vinyl ether and anhydrous maleic acid, its derivative or its mixture but other resins or microparticles may further be added thereto to adjust peeling force between the releasing layer and the protective layer. In that case, the releasing layer desirably contains a copolymer of alkyl vinyl ether and anhydrous maleic acid, its derivative or its mixture in an amount of not less than 20% by weight. A content of less than 20% by weight makes it difficult to achieve sufficient effect of a copolymer of alkyl vinyl ether and anhydrous maleic acid, its derivative or its mixture. There is usable, as a resin or microparticles to be compounded with a copolymer of alkyl vinyl ether and anhydrous maleic acid or its derivative, any material which is capable of forming highly transparent film. For example, the foregoing inorganic microparticles and a resin binder which is miscible with the inorganic microparticles are preferably used.

Examples of an ionomer usable in this invention include SERLIN A (Du Pont Co.) and CHEMIPEARL S series (Mitsui Sekiyukagaku Co., Ltd.). Further as an ionomer, for example, inorganic microparticles described above, resin binder miscible with inorganic microparticles, or other resin or microparticles may be appropriately added.

The non-transferable releasing layer is formed in such a manner that a coating solution containing either one of the foregoing compositions (1) to (3) in a prescribed compounding ratio is prepared and the thus prepared coating solution is coated on a substrate sheet by commonly known methods such as a gravure coating method or gravure reverse coating method and the coated layer is dried. The dry thickness of a non-transferable releasing layer is preferably from 0.1 to 2.0 μm.

A thermally transferable protective layer which is provided on a substrate sheet with or without intervening with the foregoing non-transferable releasing layer, may be a single layer structure or a multilayer structure. In the case of a multilayer structure, in addition to the main protective layer mainly contributing to provide various kinds of durability to images, for example, an adhesion layer may be arranged on the outermost surface of the thermally transferable protective layer to enhance adhesion between the thermally transferable protective layer and the image receiving surface of printed material, or there may be provided a preliminary protective layer or a layer to provide a function other than functions inherent to the protective layer (e.g., forgery prevention, a hologram layer). The arrangement order of the main protective layer and other layers is optional, but other layers are usually arranged between the adhesion layer and the main protective layer so that the main protective layer is the outermost surface of the image receiving side after being transferred.

There may be formed an adhesion layer on the outermost surface of the thermally transferable protective layer. An adhesion layer can be formed of resin exhibiting superior adhesion property upon heating, such as acryl resin, vinyl chloride resin, vinyl acetate resin, vinyl chloride/vinyl acetate copolymer resin, polyester resin or polyamide resin. In addition to the foregoing resins, there may be optionally added an ionizing radiation curing resin or ultraviolet shielding resin. The thickness of an adhesion layer is usually from 0.1 to 5.0 μm.

To form a thermally transferable protective layer on the non-transferable releasing layer or substrate sheet, for example, a protective layer coating solution containing resin to form a protective layer, an adhesion layer coating solution containing a heat-adhesive resin and a coating solution to form an optional layer which were previously prepared, are coated on the nontransferable releasing layer or substrate sheet in the predetermined order and then dried. The respective coating solutions are coated in commonly known methods. There may be provided a primer later between the respective layers.

Ultraviolet Absorbent

At least one of the thermally transferable protective layers preferably contains an ultraviolet absorbent. When contained in a transparent resin layer, the transparent resin layer is present on the outermost surface of printed material after the protective layer is transferred and subjects to influences from its surroundings over a long period of time, resulting in lowering in its effects, so that it is preferred to be contained in a heat-sensitive adhesive layer.

Ultraviolet absorbents include a salicylic acid type, benzophenone type, benzotriazole type and cyanoacrylate type, which are commercially available under such trade names as Tinuvin P, Tinuvin 234, Tinuvin 326, Tinuvin 327, Tinuvin 328, Tinuvin 312 and Tinuvin 315 (Ciba Geigy); Sumisorb-110, Sumisorb-130, Sumisorb-140, Sumisorb-200, Sumisorb-250, Sumisorb-300, Sumisorb-320, Sumisorb-340, Sumisorb-350 and Sumisorb-400 (Sumitomo Kagakukogyo Co., Ltd.); Mark LA-32, Mark LA-36, and Mark 1413 (Adeka Argas Kagaku Co., Ltd.) and these are usable in this invention.

There is also usable a random copolymer exhibiting a Tg of at least 60° C. (preferably, at least 80° C.) which can be obtained by allowing a reactive ultraviolet absorbent and an acryl monomer to randomly copolymerized. As the foregoing reactive ultraviolet absorbents are usable those which are obtained by introducing an addition-polymerizable double bond such as a vinyl group, acryloyl group or methacryloyl group, alcoholic hydroxyl group, amino group, carboxyl group, epoxy group or isocyanate group into non-reactive ultraviolet absorbents of commonly known salicylate type, benzophenone type, benzotriazole type, substituted acrylonitrile type, nickel chelate type and hindered amine type, and which are commercially available in such trade name as UVA635L and UVA633L (manufactured by BASF Japan Co., Ltd.); and PUVA-30M (manufactured by Otsuka Kagaku Co., Ltd.), any of which are usable in this invention.

In the random copolymer of a reactive ultraviolet absorbent and acrylic monomer, the content of a reactive ultraviolet absorbent is usually from 10% to 90% by weight, and preferably from 30% to 70%. Such a random copolymer has a molecular weight of 5,000 to 250,000, and preferably 9,000 to 30,000. The foregoing ultraviolet absorbent and random copolymer of a reactive ultraviolet absorbent and acrylic monomer may be contained singly or in combination. A random copolymer of a reactive ultraviolet absorbent and acrylic monomer is contained preferably in an amount of 5 to 50% by weight, based on the layer to be contained.

In addition to an ultraviolet absorbent, there may be incorporated other light stabilizing agents. The light stabilizing agent is a chemical capable of preventing a dye from deterioration or decomposition by absorbing or shielding an action of deteriorating or decomposing a dye, such as light energy, heat energy or an oxidizing action. Specific examples thereof include light stabilizers conventionally known as additives to synthetic resin as well as the foregoing ultraviolet absorbent. It may be incorporated to at least one of the thermally transferable layers, i.e., at least one of the foregoing peeling layer, transparent resin layer and heat-sensitive adhesion layer.

The foregoing light stabilizing agents including an ultraviolet absorber are contained preferably in an amount of from 0.05 to 10 parts by weight, and more preferably from 3 to 10 parts by weight, based on 100 parts of the resin forming the layer. An excessively small amount is difficult to achieve desired effects as a light stabilizing agent and an excessively large amount is not economical.

In addition to the light stabilizing agent, various additives such as a brightener or filler may be incorporated in an appropriate amount to the adhesion layer.

The transparent resin layer of a protective layer transfer sheet may be provided on a substrate sheet alone or face-sequentially to an ink layer of the transfer sheet.

Heat-resistant Slip Layer

The ink sheet is preferably provided with a heat-resistant slip layer on the opposite side of a substrate sheet from an ink layer. The heat-resistant slip layer prevents thermal fusion of the substrate sheet with a heating device such a thermal head and achieves smooth traveling performance, and also removes deposits onto a thermal head.

Natural or synthetic resins are employed alone or in combination, as a resin used for the heat-resistant slip layer and examples thereof include cellulose type resin such as ethyl cellulose, hydroxyethyl cellulose, hydroxypropyl cellulose, methyl cellulose, cellulose acetate, cellulose acetate butyrate and nitrocellulose; vinyl type resin such as polyvinyl alcohol, polyvinyl acetate, polyvinyl butyral, polyvinyl acetal and polyvinyl pyrrolidone; acryl type resin such as poly(methyl methacrylate), poly(ethyl acrylate), polyacrylamide and acrylonitrile-styrene copolymer; polyimide resin, polyamide resin, polyamidoimide resin, polyvinyltoluene resin, chromaneindene resin, polyester type resin, polyurethane resin, silicon- or fluorine-modified urethane resin. It is preferred that, to enhance heat resistance of the heat-resistant slip layer, a resin containing a reactive hydroxyl group, of the foregoing resins, is used in combination with a curing agent such as polyisocyanate to form a cured resin layer.

To provide lubricating capability on a thermal head, a solid or liquid mold-releasing agent or lubricant may be added to the heat-resistant slip layer to enhance heat-resistance. Examples of a mold-releasing agent or lubricant include waxes such polyethylene wax or paraffin wax, higher aliphatic alcohol, organosiloxane, anionic surfactants, cationic surfactants, amphoteric surfactants, nonionic surfactants, fluorinated surfactants, metal soap, organic carboxylic acids and their derivatives, fluororesin, silicone resin, and inorganic particles such as talc or silica. A lubricant is contained in the heat-resistant slip layer in an amount of 5% to 50% by weight, and preferably 10% to 30%. The thickness of a heat-resistant slip layer is usually from 0.1 to 10.0 μm, and preferably 0.3 to 5.0 μm.

Next, there will be described an image forming method by using a thermal transfer recording material.

Image Forming Method

First, the print rate relating to this invention will be described.

The print rate as defined in this invention is represented in printing time and when heated by a thermal head or a heating roller, the print rate is represented by the printing time per line (msec/line). In this invention, the print rate is not more than 1.5 msec/line, whereby superior print density and light fastness are maintained at an enhanced print efficiency as defined in this invention. The print rate is preferably not more than 0.5 msec/line, whereby superior print density and light fastness can be maintained at a further enhanced print efficiency. A print rate closer to zero may be desirable but its lower limit is 0.05 msec/line in terms of the maintaining control of the thermal transfer recording apparatus and practical use.

Next, there will be described constitution of a thermal transfer ink sheet.

FIG. 2(*a*) and FIG. 2(*b*) each show a perspective view of a thermal transfer ink sheet relating to this invention. FIG. 2(*a*) is a perspective view showing one embodiment of supplying the ink sheet of this invention in one face-sequence. In FIG. 2(*a*), ink sheet (11) is provided with ink layers 13Y, 13M and 13C corresponding to the respective dyes of yellow (Y), magenta (M) and cyan (C), and a thermally transferable protective layer (14) which is capable of being released and is located in a separate region from the dye layer, in a face-sequence on the same surface of a support (12). A back layer is also provided on the other side of the support (12). FIG. 2(*b*) is a perspective view of one preferred embodiment, in which a thermally transferable protective layer (14) is provided on a support (12') which is different from the support (12) provided thereon with ink layers 13Y, 13M and 13C.

In FIGS. 2(*a*) and (*b*), a slight spacing is provided between the respective ink layers but a spacing may optimally be provided in accordance with the control method of a thermal transfer recording apparatus. To precisely access the respective ink layers, it is preferred to provide a detection mark onto an ink sheet and the method thereof is not specifically limited. In the foregoing, the respective ink layers, and a thermally transferable protective layer or a post-heat treatment region are shown to be provided on the same plane surface but it is obvious that the respective layers may be provided on separate sheets. In cases when reactive dyes are used in the respective ink layers, the dyes contained in them are unreacted compounds, and, strictly speaking, they are not Y, M and C dyes, but the respective ink layers are similarly represented, for convenience, in a sense of layers to finally form Y, M and C images.

Figure 3:
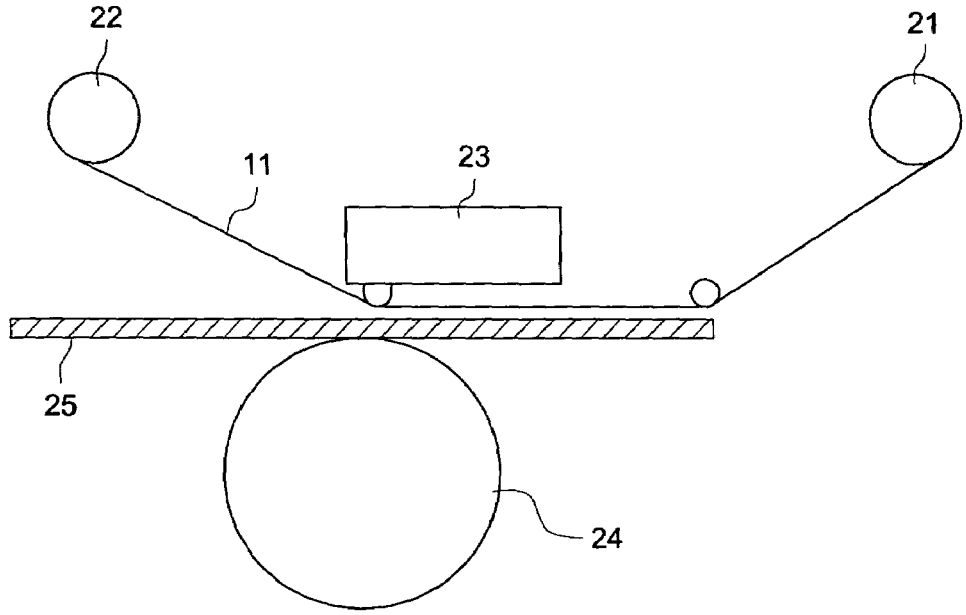
FIG. 3 illustrates a thermal transfer recording apparatus usable in the invention.

In the image forming method of this invention, a thermal transfer recording apparatus is usable, for example, as shown in FIG. 3. In FIG. 3, the numeral 21 designates a supply roll for thermal transfer ink sheet, the numeral 11 designates thermal transfer ink sheet, the numeral 22 designates a reel roll to take up the used thermal ink sheet (11) the numerals 23 and 24 designate a thermal head and a platen roller, respectively; the numeral 25 designates a thermal transfer image receiving sheet which is charged between the thermal head (23) and the platen roller (24).

An image forming process by using a thermal transfer recording apparatus shown in FIG. 3 and a thermal transfer ink sheet, for example, as shown in FIG. 2(*a*) is described below. First, The yellow dye ink layer (13Y) of a thermal transfer ink sheet, as shown in FIG. 2(*a*) and an dye receiving layer of the thermal transfer image receiving sheet (25) are superimposed and heat applied by the thermal head (23) transfers a yellow dye from the ink layer (13Y) to the image receiving sheet, based on image data to form the yellow image. Subsequently, onto the yellow image, a magenta dye is imagewise transferred from the magenta dye ink layer (13M) in a similar manner. Further onto the transferred images, a cyan dye is imagewise transferred from the cyan dye ink layer (13C) similarly. Finally, onto the whole surface of the formed images, the thermally transferable protective layer unit (14) is thermally transferred from a thermal transfer sheet onto the whole surface of the formed images to complete image formation. In this invention, to complete chelation of the transferred dyes, it is preferred to subject to a post-heat treatment to complete chelation of the transferred dyes. The post-heat treatment may be conducted concurrently with transfer of the transferable protective layer unit.

In the thermal transfer recording apparatus used in this invention, it is preferred to make it feasible to select control of a glossy tone or matte tone within the same apparatus, whereby a printed material of a desired surface property can be obtained in a single apparatus, the selection methods for which are not specifically limited. For example, control data corresponding to glossy tone and matte tone are held within a thermal transfer recording apparatus and the selected control data are read by a simple operation of the operator to control the control section based on the read data. Alternatively, when a personal computer is connected to the recording apparatus, the control data are held in the personal computer side and the selected control data may be outputted through a simple operation by the operator. In cases when heated by a heating roller, a surface-modifying material, such as a releasing sheet to give surface gross or a surface-roughened sheet to make the surface matte is overlapped on the surface of an image receiving layer and heated from the back side of the sheet to obtain a surface-modified recorded material.

EXAMPLES

The present invention will be further described based on examples but embodiments of the invention are by no means limited to these. Unless otherwise noted, term "part(s)" represents parts by weight and "%" represents % by weight.

Example 1

Ink Sheet 1

Preparation of Substrate Sheet

Using a 6 μm thick polyethylene terephthalate film (K-203E-6F, produced by Mitsubishi Kagaku Polyester Co., Ltd.), one side of which was subjected to an adhesion-promoting treatment, the following coating composition of a heat-resistant slip layer was coated by a gravure coating system on the opposite side of the film to the side subjected to an adhesion-promoting treatment and dried, and further subjected to a heat-curing treatment to prepare a substrate sheet used for an ink sheet having a heat-resistant slip layer at a dry thickness of 1 μm.

Coating Composition of Heat-resistant Slip Layer:

| | |
|---|---|
| Polyvinyl butyral resin (S-LEC BX-1 Sekisui Kagaku Kogyo) | 3.5 parts |
| Phosphoric acid ester surfactant (PRISURF A208S, Daiichi Kogyo Seiyaku) | 3.0 parts |
| Phosphoric acid ester surfactant (PHOSPHANOL RD720, Toho Kagaku) | 0.3 parts |
| Polyisocyanate (BURNOCK 750-45, Dainippon Ink Kagaku Kogyo) | 19.0 parts |
| Talc (Nippon Talc Co., Y/X = 0.03) | 0.2 parts |
| Methyl ethyl ketone | 35.0 parts |
| Toluene | 35.0 parts |

Preparation and Coating of Protective Layer Coating Solution

On the opposite side of polyethylene terephthalate film from the heat-resistant slip layer, a releasing layer coating solution having the following composition was coated in a wire-bar coating system and dried to form a releasing layer of a dry thickness of 1.0 μm. Further on the releasing layer, a protective layer coating solution having the following composition was coated and dried to provide a protective layer of a dry thickness of 2.0 μm. There was thus formed a sheet having a transferable protective layer.

Coating Composition of Releasing Layer:

| | |
|---|---|
| Polyurethane resin (HYDRAN AP-40, produced by DAINIPPON INK & CHEMICALS, INC.) | 5.0 parts |
| Polyvinyl alcohol resin (GOSENOL C500, produced by Nippon Goseikagaku Kogyo) | 8.0 parts |
| Water | 80.0 parts |
| Ethanol | 80.0 parts |

Coating Composition of Protective Layer

| | |
|---|---|
| Copolymer resin with an attached reactive UV absorber (UVA 635L, produced by BASF Japan) | 2.5 parts |

-continued

| | |
|---|---|
| Acryl resin (DIANAL BR83, produced by Mitsubishi rayon Co., Ltd.) | 15.0 parts |
| Methyl ethyl ketone | 100.0 parts |

Preparation of Ink Layer Coating Solution

Next, on the same surface of the substrate sheet as the transferable protective layer, a yellow ink coating solution, a magenta ink coating solution and a cyan ink coating solution to form yellow (Y), magenta (M) and cyan (C) ink layers were each coated successively by a gravure coating system and dried at 100° C. for 1 min. to form the respective ink layers (a dry thickness of 0.8 μm) to obtain ink sheet 1, in which the respective ink layers and a protective layer were arranged in order, as shown in FIG. 2(*a*).

Yellow Ink Coating Solution 1:

| | |
|---|---|
| Post-chelate dye (Y-1) | 5.0 parts |
| Polyvinyl acetal resin (S-LEC KX-5 Sekisui Kagaku Kogyo) | 5.0 parts |
| Urethane-modified silicone resin (DAIALOMER SP-2105, Dainichiseika Kogyo) | 0.5 parts |
| Methyl ethyl ketone | 45.0 parts |
| Toluene | 45.0 parts |

Magenta Ink Coating Solution 1:

| | |
|---|---|
| Post-chelate dye (M-1) | 5.0 parts |
| Polyvinyl acetal resin (S-LEC KX-5 Sekisui Kagaku Kogyo) | 5.0 parts |
| Urethane-modified silicone resin (DAIALOMER SP-2105, Dainichiseika Kogyo) | 0.5 parts |
| Methyl ethyl ketone | 45.0 parts |
| Toluene | 45.0 parts |

Cyan Ink Coating Solution 1:

| | |
|---|---|
| Post-chelate dye (C-1) | 5.0 parts |
| Polyvinyl acetal resin (S-LEC KX-5 Sekisui Kagaku Kogyo) | 5.0 parts |
| Urethane-modified silicone resin (DAIALOMER SP-2105, Dainichiseika Kogyo) | 0.5 parts |
| Methyl ethyl ketone | 45.0 parts |
| Toluene | 45.0 parts |

Y-1

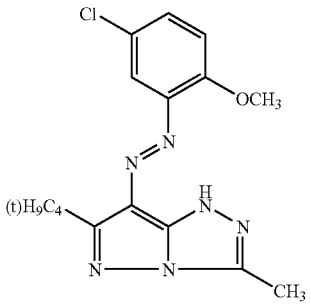

-continued

M-1

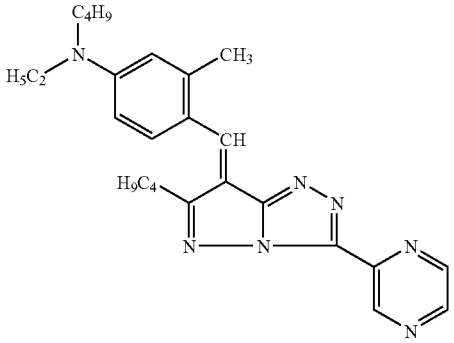

C-1

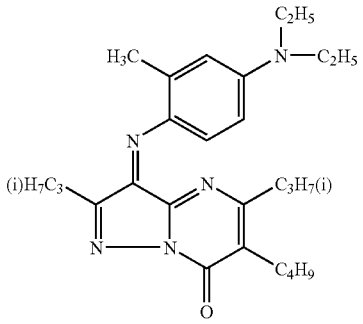

Thermal Transfer Image Receiving Sheet

Preparation of Image Receiving Sheet 1-1

On one side of a 150 μm thick synthetic plastic paper sheet as a substrate sheet (YUPO FPG-150, manufactured by Oji Yuka Goseishi Co., Ltd.), the following interlayer coating solution was coated in a wire-bar coating system and dried at 120° C. for 1 min. to form an interlayer having a dry solid content of 1.5 g/m$^2$. Subsequently, on the sublayer, a dye receiving layer coating solution (1) having the following composition was coated in a wire-bar coating system and dried at 130° C. for 1 min. to obtain a thermal transfer image receiving sheet 1-1 with a dry solid content of 4.0 g/m$^2$.

Interlayer Coating Solution

| | |
|---|---|
| Urethane resin (NIPORAN 5199, produced by Nippon Urethane Co., Ltd.) | 5.5 parts |
| Isocyanate (TAKENATE A-14, produced by Takeda Chemical Industries Ltd.) | 2.0 parts |
| Methyl ethyl ketone | 20.0 parts |
| Toluene | 20.0 parts |

Dye Receiving Layer Coating Solution:

| | |
|---|---|
| Vinyl chloride vinyl acetate copolymer resin (#1000ALK, DENKKAGAKU KOGYO LTD) | 7.0 parts |
| Metal source (MS-1*) | 3.0 parts |
| Methylstyryl-modified silicone oil (KF410, Shi-Etsu Kagaku Kogyo) | 0.5 part |
| Methyl ethyl ketone | 40.0 parts |

-continued

| | |
|---|---|
| Toluene | 40.0 parts |
| Butyl acetate | 10.0 parts |

MS-1*: $Ni^{2+}[C_7H_{15}COC(COOCH_3)=C(CH_3)O^-]_2$

Preparation of Image Receiving Sheets 1-2 to 1-21

Thermal transfer image receiving sheets 1-2 to 1-21 were prepared similarly to the foregoing thermal transfer image receiving sheets 1-1, provided that the metal source of the dye receiving layer was varied and metal ion species were further incorporated in amounts equimolar with a metal source, as shown in Table 1. A metal source was incorporated in an effective metal amount of 0.16 part.

Details of additives shown in Table 1 are as follows.

Metal Source:

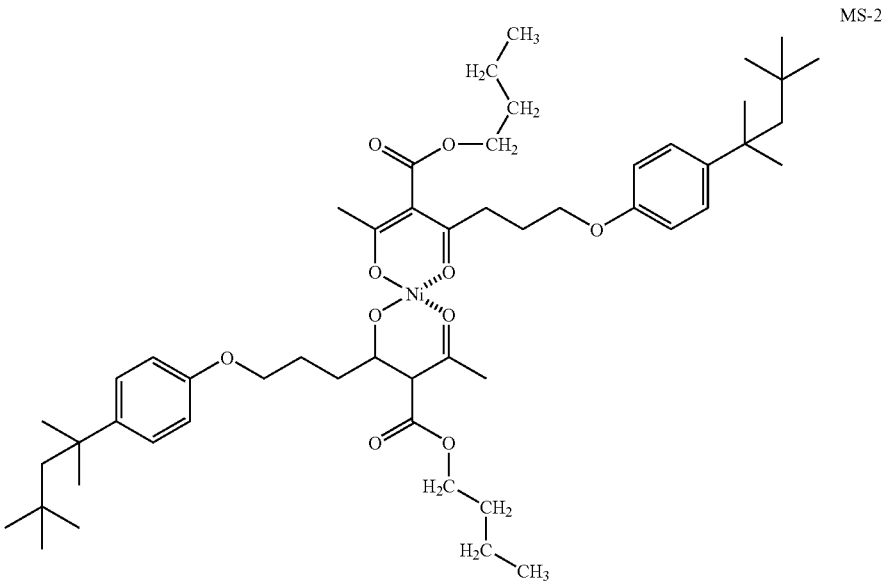

MS-3: $Co^{2+}[C_7H_{15}COC(COOCH_3)=C(CH_3)O^-]_2$
MS-4: $Cu^{2+}[C_7H_{15}COC(COOCH_3)=C(CH_3)O^-]_2$
MS-5: $Zn^{2+}[C_7H_{15}COC(COOCH_3)=C(CH_3)O^-]_2$

Metal Ion Species:

M-1: zinc oleate (effective metal content 10%)
M-2: magnesium oleate (effective metal content 10%)
M-3: cobalt oleate (effective metal content 10%)
M-4: copper oleate (effective metal content 10%)
M-5: aluminum oleate (effective metal content 10%)
M-6: acetylacetonatocobalt (effective metal content 20%)
M-7: acetylacetonatomagnesium (effective metal content 20%)
M-8: acetylacetonatozinc (effective metal content 20%)
M-9: acetylacetonatocopper (effective metal content 20%)
M-10: acetylacetonatoaluminum (effective metal content 20%)
M-11: acetylacetonatonickel dihydrate (effective metal content 20%)
M-12: magnesium oleate (effective metal content 10%)/cobalt oleate (effective metal content 10%)=1/1 (molar ratio of effective metal content)
M-13: magnesium oleate (effective metal content 10%)/copper oleate (effective metal content 10%)=1/1 (molar ratio of effective metal content)
M-14: magnesium oleate (effective metal content 10%)/aluminum oleate (effective metal content 10%) 1/1 (molar ratio of effective metal content)
M-15: magnesium oleate (effective metal content 10%)/zinc oleate (effective metal content 10%)=1/1 (molar ratio of effective metal content)

Image Formation

As shown in FIG. 3, in a thermal transfer recording apparatus installed with a thermal head of a square resistor (80 μm in the main scanning direction x 120 μm in the sub-scanning direction) and 300 dpi (dpi: number of dots per inch or 2.54 cm), the image receiving section of the respective image receiving sheets was superimposed onto the ink layer of an ink sheet in the combination of an image receiving sheet and an ink sheet, as shown in Table 3 and set; step pattern patches of yellow, magenta and cyan were successively printed by heating from the side opposite the ink layer at a feed length of 10 85 μm per line, while pressing by a thermal head and a platen roll and increasing an applied energy within the range of 0 to 260 μJ/dot, and the respective dyes were transferred onto the image receiving layer of an ink sheet to form images 1-1 to 1-42, each having a neutral step pattern image (formed by overlapping three colors of yellow, magenta and cyan).

Print Efficiency

A reciprocal of a print rate [i.e., the number of lines per unit time (msec)] was calculated for each and represented by a relative value, as a measure of print efficiency, based on the number of lines per unit time (msec) at a print rate of 1.5 msec/line being 1.00.

Evaluation of Formed Image

Maximum Density

Using a reflection densitometer (X-rite 310, manufactured by Gretag Macbeth Corp.), the printed neutral step pattern patch images were measured with respect to cyan maximum reflection density (denoted as DmaxC).

Light Fastness

In the printed neutral step pattern patches, the density ($D_1$) of a step exhibiting a cyan reflection density near 1.0 was measured using the foregoing reflection densitometer of Gretag Macbeth Corp. and after exposed in a xenon fadometer (at 70,000 lux) for one week, the reflection density ($D_2$) of the same step was measured similarly. The dye residual ratio was determined according to the following equation, as a measure of light fastness:

Dye residual ratio (%)=[reflection density after exposure($D_2$)]/[reflection density before exposure ($D_1$)]×100

The thus obtained measurement results and evaluation results are shown in Table 1.

TABLE 1

| | Image Receiving Sheet | | | | | | Light | |
|---|---|---|---|---|---|---|---|---|
| Image No. | *S | No. | *MS | Metal Ion Species | Print Efficiency | DmaxC | Fastness (%) | Remark |
| 1-1 | 1.9 | 1-1 | MS-1 | — | 0.79 | 2.01 | 89 | Comp. |
| 1-2 | 1.7 | 1-1 | MS-1 | — | 0.88 | 2.01 | 89 | Comp. |
| 1-3 | 1.5 | 1-1 | MS-1 | — | 1.00 | 1.72 | 73 | Comp. |
| 1-4 | 1.3 | 1-1 | MS-1 | — | 1.15 | 1.72 | 72 | Comp. |
| 1-5 | 1.1 | 1-1 | MS-1 | — | 1.36 | 1.71 | 72 | Comp. |
| 1-6 | 0.5 | 1-1 | MS-1 | — | 3.00 | 1.51 | 62 | Comp. |
| 1-7 | 1.5 | 1-2 | MS-1 | M-1 | 1.00 | 2.02 | 89 | Inv. |
| 1-8 | 1.3 | 1-2 | MS-1 | M-1 | 1.15 | 2.02 | 88 | Inv. |
| 1-9 | 1.1 | 1-2 | MS-1 | M-1 | 1.36 | 2.01 | 88 | Inv. |
| 1-10 | 0.5 | 1-2 | MS-1 | M-1 | 3.00 | 1.94 | 81 | Inv. |
| 1-11 | 0.1 | 1-2 | MS-1 | M-1 | 15.0 | 1.88 | 81 | Inv. |
| 1-12 | 1.5 | 1-3 | MS-1 | M-2 | 1.00 | 2.02 | 88 | Inv. |
| 1-13 | 1.3 | 1-3 | MS-1 | M-2 | 1.15 | 2.02 | 89 | Inv. |
| 1-14 | 1.1 | 1-3 | MS-1 | M-2 | 1.36 | 2.01 | 88 | Inv. |
| 1-15 | 0.5 | 1-3 | MS-1 | M-2 | 3.00 | 1.93 | 80 | Inv. |
| 1-16 | 0.1 | 1-3 | MS-1 | M-2 | 15.0 | 1.87 | 80 | Inv. |
| 1-17 | 1.9 | 1-4 | MS-2 | — | 0.79 | 2.01 | 89 | Comp. |
| 1-18 | 1.7 | 1-4 | MS-2 | — | 0.88 | 2.01 | 89 | Comp. |
| 1-19 | 1.5 | 1-4 | MS-2 | — | 1.00 | 1.72 | 73 | Comp. |
| 1-20 | 1.3 | 1-4 | MS-2 | — | 1.15 | 1.71 | 72 | Comp. |
| 1-21 | 1.1 | 1-4 | MS-2 | — | 1.36 | 1.71 | 72 | Comp. |
| 1-22 | 0.5 | 1-4 | MS-2 | — | 3.00 | 1.50 | 63 | Comp. |
| 1-23 | 1.5 | 1-5 | MS-2 | M-2 | 1.00 | 2.01 | 89 | Inv. |
| 1-24 | 1.3 | 1-5 | MS-2 | M-2 | 1.15 | 2.02 | 88 | Inv. |
| 1-25 | 1.1 | 1-5 | MS-2 | M-2 | 1.36 | 2.01 | 88 | Inv. |
| 1-26 | 0.5 | 1-5 | MS-2 | M-2 | 3.00 | 1.94 | 82 | Inv. |
| 1-27 | 1.1 | 1-6 | MS-1 | M-12 | 1.36 | 2.01 | 88 | Inv. |
| 1-28 | 1.1 | 1-7 | MS-1 | M-13 | 1.36 | 2.02 | 88 | Inv. |
| 1-29 | 1.1 | 1-8 | MS-1 | M-14 | 1.36 | 2.01 | 89 | Inv. |
| 1-30 | 1.1 | 1-9 | MS-1 | M-15 | 1.36 | 2.02 | 89 | Inv. |
| 1-31 | 1.1 | 1-10 | MS-1 | M-3 | 1.36 | 2.01 | 88 | Inv. |
| 1-32 | 1.1 | 1-11 | MS-1 | M-4 | 1.36 | 2.02 | 88 | Inv. |
| 1-33 | 1.1 | 1-12 | MS-1 | M-5 | 1.36 | 2.01 | 89 | Inv. |
| 1-34 | 1.1 | 1-13 | MS-1 | M-6 | 1.36 | 2.01 | 88 | Inv. |
| 1-35 | 1.1 | 1-14 | MS-1 | M-7 | 1.36 | 2.01 | 88 | Inv. |
| 1-36 | 1.1 | 1-15 | MS-1 | M-8 | 1.36 | 2.02 | 89 | Inv. |
| 1-37 | 1.1 | 1-16 | MS-1 | M-9 | 1.36 | 2.01 | 88 | Inv. |
| 1-38 | 1.1 | 1-17 | MS-1 | M-10 | 1.36 | 2.02 | 89 | Inv. |
| 1-39 | 1.1 | 1-18 | MS-3 | M-11 | 1.36 | 2.01 | 88 | Inv. |
| 1-40 | 1.1 | 1-19 | MS-3 | M-2 | 1.36 | 2.01 | 88 | Inv. |
| 1-41 | 1.1 | 1-20 | MS-4 | M-2 | 1.36 | 2.02 | 89 | Inv. |
| 1-42 | 1.1 | 1-21 | MS-5 | M-2 | 1.36 | 2.01 | 88 | Inv. |

*S: print rate (msec/line)
*MS: metal ion containing compound (or metal source)

As apparent from the results shown in Table 1, it was proved that in comparative examples, a lowering of maximum density and deteriorated light fastness were caused when image formation was carried out under high-speed printing conditions at a print rate of 1.5 msec/line or less, making print efficiency and image characteristics incompatible with each other. On the contrary, it was shown that incorporation of a metal ion-containing compound (metal source) and a metal ion species different from the metal ion-containing compound resulted in an enhanced maximum density and superior light fastness even when printed under high-speed printing conditions at a print rate of 1.5 msec/line or less, achieving enhanced print efficiency compatible with superior image characteristics. It was also shown that enhancement of the maximum density was marked when image formation was carried out under the high print efficiency condition of the print rate of 0.5 msec/line.

Example 2

Thermal transfer image receiving sheets 2-1 to 2-10 were prepared similarly to the foregoing image receiving sheet 1-3 of Example 1, except that, as shown in Table 2, the metal ion molar ratio of a metal ion-containing compound (or a metal source) to a metal ion species different from the metal ion-containing compound was varied, based on the metal ion mole number of a metal ion containing compound being 1.00. After the prepared image receiving sheets 2-1 to 2-10 were aged for two weeks under an environment of 50° C. and 80% RH, image formation and evaluation thereof were conducted using the thus aged image receiving sheets and ink sheet 1 used in Example 1, in a manner similar to Example 1. The print rate was 1.1 msec/line.

The thus obtained measurement results and evaluation results are shown in Table 2.

TABLE 2

| Image Receiving Sheet No. | Metal Ion Containing Compound:Metal Ion Species (Metal Molar Ratio) | DmaxC | Light Fastness (%) |
|---|---|---|---|
| 2-1 | 1.00:0.24 | 1.82 | 78 |
| 2-2 | 1.00:0.22 | 1.82 | 79 |
| 2-3 | 1.00:0.20 | 1.93 | 87 |
| 2-4 | 1.00:0.18 | 1.94 | 88 |
| 2-5 | 1.00:0.16 | 1.94 | 88 |
| 2-6 | 1.00:0.05 | 1.94 | 88 |
| 2-7 | 1.00:0.04 | 1.93 | 87 |
| 2-8 | 1.00:0.03 | 1.93 | 87 |
| 2-9 | 1.00:0.02 | 1.93 | 87 |
| 2-10 | 1.00:0.01 | 1.81 | 78 |

As apparent from the results shown in Table 2, it was proved that a metal ion molar ratio of a metal source to a metal ion species different from the metal source falling within the range from 1.00:0.20 to 1.00:0.02 maintained a high maximum density and superior light fastness, achieving enhanced print efficiency compatible with superior image characteristics, even when image formation was performed at a high-speed print condition of 1.1 msec/line or less after an image receiving sheet was aged over a long-term under severe conditions.

Example 3

Preparation of Image Receiving Sheets 3-1 to 3-26

Thermal transfer image receiving sheets 3-1 to 3-26 were prepared similarly to the foregoing image receiving sheet 1-1 or 1-4 of Example 1, except that the kind of a metal source of the dye receiving layer was varied and various additives were incorporated, as shown in Table 3.

Details of additives designated in Table 3 are as follows.

S-1: sorvitan monostearate
S-2: tricresyl phosphate
S-3: sorvitan monolaurate
S-4: sorvitane monooleate
S-5: polyoxyethylene sorvitan monooleate
S-6: polyoxyethylene sorvitan monostearate
S-7: polyoxyethylene sorvitan monolaurate
S-8: sorvitan monostearate/tricresyl phosphate (1/1)
S-9: sorvitan monostearate/polyoxyethylene sorvitan monolaurate (1/1)
S-10: sorvitan monostearate/polyethylene glycol #1000 (1/1)
S-11: sorvitan monostearate/exemplified compound 1-1 (1/1)
S-12: tricresyl phosphate/polyoxyethylene sorvitan monolaurate (1/1)
S-13: tricresyl phosphate/polyoxyethylene sorvitan monolaurate (1/1)
S-14: tricresyl phosphate/exemplified compound 1-1 (1/1)
S-15: polyoxyethylene sorvitan monolaurate/polyethylene glycol #1000 (1/1)
S-16: polyethylene glycol #1000 (1/1)
S-17: polyethylene glycol #1000 (1/1)
S-18: polytetramethylene glycol #1000 (1/1)
S-19: exemplified compound (1/1)
S-20: trixylenyl phosphate
S-21: trioctyl phosphate The foregoing numerals in parentheses represent the weight ratio of the respective additives.

Image Formation

Using the thus prepared image receiving sheets 3-1 to 3-26, and image receiving sheets 1-1 and 1-4, images 3-1 to 3-49 were each formed according to the following procedure.

In the thermal transfer recording apparatus described in Example 1, the image receiving section of each of the foregoing image receiving sheets and ink sheet 1 described in Example 1 were superimposed, set and printed similarly to Example 1, provided that the print rate was varied as shown in Table 3. Similarly to Example 1, the thus obtained images 3-1 to 3-49 were evaluated with respect to maximum density and light fastness. Obtained results are shown in Table 3.

TABLE 3

| Image No. | *S | Image Receiving Sheet No. | *MS | Additive | Print Efficiency | DmaxC | Light Fastness (%) | Remark |
|---|---|---|---|---|---|---|---|---|
| 3-1 | 1.9 | 1-1 | MS-1 | — | 0.79 | 2.01 | 89 | Comp. |
| 3-2 | 1.7 | 1-1 | MS-1 | — | 0.88 | 2.01 | 89 | Comp. |
| 3-3 | 1.5 | 1-1 | MS-1 | — | 1.00 | 1.72 | 73 | Comp. |
| 3-4 | 1.3 | 1-1 | MS-1 | — | 1.15 | 1.72 | 72 | Comp. |
| 3-5 | 1.1 | 1-1 | MS-1 | — | 1.36 | 1.71 | 72 | Comp. |
| 3-6 | 0.5 | 1-1 | MS-1 | — | 3.00 | 1.51 | 62 | Comp. |
| 3-7 | 1.5 | 3-1 | MS-1 | S-1 | 1.00 | 2.01 | 89 | Inv. |
| 3-8 | 1.3 | 3-1 | MS-1 | S-1 | 1.15 | 2.01 | 88 | Inv. |
| 3-9 | 1.1 | 3-1 | MS-1 | S-1 | 1.36 | 2.01 | 88 | Inv. |
| 3-10 | 0.5 | 3-1 | MS-1 | S-1 | 3.00 | 1.93 | 82 | Inv. |
| 3-11 | 0.1 | 3-1 | MS-1 | S-1 | 15.0 | 1.87 | 82 | Inv. |
| 3-12 | 1.5 | 3-2 | MS-1 | S-2 | 1.00 | 2.02 | 89 | Inv. |
| 3-13 | 1.3 | 3-2 | MS-1 | S-2 | 1.15 | 2.01 | 89 | Inv. |
| 3-14 | 1.1 | 3-2 | MS-1 | S-2 | 1.36 | 2.01 | 89 | Inv. |
| 3-15 | 0.5 | 3-2 | MS-1 | S-2 | 3.00 | 1.91 | 83 | Inv. |
| 3-16 | 0.1 | 3-2 | MS-1 | S-2 | 15.0 | 1.85 | 83 | Inv. |
| 3-17 | 1.9 | 1-4 | MS-2 | — | 0.79 | 2.01 | 89 | Comp. |
| 3-18 | 1.7 | 1-4 | MS-2 | — | 0.88 | 2.01 | 89 | Comp. |
| 3-19 | 1.5 | 1-4 | MS-2 | — | 1.00 | 1.72 | 73 | Comp. |
| 3-20 | 1.3 | 1-4 | MS-2 | — | 1.15 | 1.71 | 72 | Comp. |
| 3-21 | 1.1 | 1-4 | MS-2 | — | 1.36 | 1.71 | 72 | Comp. |
| 3-22 | 0.5 | 1-4 | MS-2 | — | 3.00 | 1.50 | 63 | Comp. |
| 3-23 | 1.5 | 3-3 | MS-2 | S-1 | 1.00 | 2.02 | 88 | Inv. |
| 3-24 | 1.3 | 3-3 | MS-2 | S-1 | 1.15 | 2.02 | 88 | Inv. |
| 3-25 | 1.1 | 3-3 | MS-2 | S-1 | 1.36 | 2.01 | 88 | Inv. |
| 3-26 | 0.5 | 3-3 | MS-2 | S-1 | 3.00 | 1.93 | 82 | Inv. |
| 3-27 | 1.1 | 3-4 | MS-1 | S-3 | 1.36 | 2.01 | 89 | Inv. |
| 3-28 | 1.1 | 3-5 | MS-1 | S-4 | 1.36 | 2.02 | 88 | Inv. |
| 3-29 | 1.1 | 3-6 | MS-1 | S-5 | 1.36 | 2.01 | 89 | Inv. |
| 3-30 | 1.1 | 3-7 | MS-1 | S-6 | 1.36 | 2.02 | 89 | Inv. |
| 3-31 | 1.1 | 3-8 | MS-1 | S-7 | 1.36 | 2.02 | 88 | Inv. |
| 3-32 | 1.1 | 3-9 | MS-1 | S-8 | 1.36 | 2.01 | 89 | Inv. |
| 3-33 | 1.1 | 3-10 | MS-1 | S-9 | 1.36 | 2.01 | 89 | Inv. |
| 3-34 | 1.1 | 3-11 | MS-1 | S-10 | 1.36 | 2.01 | 88 | Inv. |
| 3-35 | 1.1 | 3-12 | MS-1 | S-11 | 1.36 | 2.02 | 89 | Inv. |
| 3-36 | 1.1 | 3-13 | MS-1 | S-12 | 1.36 | 2.02 | 89 | Inv. |
| 3-37 | 1.1 | 3-14 | MS-1 | S-13 | 1.36 | 2.01 | 88 | Inv. |
| 3-38 | 1.1 | 3-15 | MS-1 | S-14 | 1.36 | 2.01 | 88 | Inv. |
| 3-39 | 1.1 | 3-16 | MS-1 | S-15 | 1.36 | 2.02 | 89 | Inv. |
| 3-40 | 1.1 | 3-17 | MS-1 | S-16 | 1.36 | 2.02 | 88 | Inv. |
| 3-41 | 1.1 | 3-18 | MS-1 | S-17 | 1.36 | 2.01 | 88 | Inv. |
| 3-42 | 1.1 | 3-19 | MS-1 | S-18 | 1.36 | 2.01 | 89 | Inv. |
| 3-43 | 1.1 | 3-20 | MS-1 | S-19 | 1.36 | 2.02 | 89 | Inv. |
| 3-44 | 1.1 | 3-21 | MS-1 | S-20 | 1.36 | 2.02 | 89 | Inv. |
| 3-45 | 1.1 | 3-22 | MS-1 | S-21 | 1.36 | 2.02 | 89 | Inv. |
| 3-46 | 1.1 | 3-23 | MS-2 | S-7 | 1.36 | 2.01 | 88 | Inv. |
| 3-47 | 1.1 | 3-24 | MS-2 | S-17 | 1.36 | 2.02 | 89 | Inv. |
| 3-48 | 1.1 | 3-25 | MS-2 | S-19 | 1.36 | 2.01 | 88 | Inv. |
| 3-49 | 1.1 | 3-26 | MS-2 | S-21 | 1.36 | 2.02 | 89 | Inv. |

*S: print rate (msec/line)
*MS: metal ion containing compound (or metal source)

As apparent from the results shown in Table 3, it was proved that in comparative examples, lowering in maximum density and deteriorated light fastness were caused when image formation was carried out under high-speed printing conditions at a print rate of 1.5 msec/line or less, making print efficiency and image characteristics incompatible with each other. On the contrary, it was shown that incorporation of a metal ion-containing compound (metal source) in combination with a sorvitan fatty acid ester, a polyoxyethylene group-containing sorvitan fatty acid ester, a phosphoric acid ester compound, or a compound of formula (1) or (2) resulted in an enhanced maximum density and superior light fastness even when printed under high-speed printing conditions at a print rate of 1.5 msec/line or less, achieving enhanced print efficiency compatible with superior image characteristics. It was also shown that enhancement of the maximum density was marked when image formation was carried out under the high print efficiency condition of the print rate of 0.5 msec/line.

Example 4

Thermal transfer image receiving sheets 4-1 to 4-10 were prepared similarly to a thermal transfer sheet 3-2 described in Example 3, except that the weight ratio of vinyl chloride vinyl acetate copolymer resin to an additive (S-2: tricresyl phosphate) used in the preparation of a dye receiving layer coating solution wa varied as shown in Table 4. After the prepared image receiving sheets 4-1 to 4-10 were aged for 2 weeks under an environment of 50° C. and 80% RH, image formation thereof was conducted using the thus aged image receiving sheets and ink sheet 1 used in Example 1, similarly to Example 1. The print rate was 1.1 msec/line.

The formed images were evaluated with respect to maximum density and light fastness similarly to Example 1 and further evaluated with respect to resistance to bleeding of images according to the following procedure.

Evaluation of Resistance to Bleeding

After a neutral step pattern image prepared in each sample was aged for 4 weeks under an environment of 77° C., the extent of bleeding of a dye in the boundary between the maximum density portion and the unexposed area was visually observed and evaluated based on the following criteria:

A: no bleeding was observed in a step pattern patch,

B: slight bleeding was observed but within the range acceptable in practice,

C: image bleeding was evidently observed.

The obtained results are shown in Table 4.

TABLE 4

| Image Receiving Sheet No. | Weight ratio* | DmaxC | Bleeding Resistance | Light Fastness (%) |
|---|---|---|---|---|
| 4-1 | 1.00:0.54 | 1.93 | B | 79 |
| 4-2 | 1.00:0.52 | 1.93 | B | 79 |
| 4-3 | 1.00:0.50 | 1.93 | A | 87 |
| 4-4 | 1.00:0.48 | 1.94 | A | 87 |
| 4-5 | 1.00:0.22 | 1.94 | A | 88 |
| 4-6 | 1.00:0.15 | 1.94 | A | 88 |
| 4-7 | 1.00:0.05 | 1.93 | A | 87 |
| 4-8 | 1.00:0.04 | 1.93 | A | 87 |
| 4-9 | 1.00:0.03 | 1.81 | A | 88 |
| 4-10 | 1.00:0.02 | 1.81 | A | 88 |

*weight ratio of copolymer resin of vinyl chloride/vinyl acetate:tricresyl phosphate As apparent from the results shown in Table 4, incorporation of tricresyl phosphate in combination with vinyl chloride vinyl acetate copolymer resin within the range of from 1.00:0.04 to 1.00:0.50 maintained a high maximum density and superior light fastness, achieving compatibility of print efficiency and image characteristics, even when image formation was performed at a high-speed print condition of 1.1 msec/line or less after an image receiving sheet was aged over a long-term under severe conditions. On the contrary, addition of tricresyl phosphate in a proportion exceeding 0.50, based on vinyl chloride vinyl acetate copolymer resin resulted in marked deterioration in bleeding resistance and light fastness after being aged. Further, adding tricresyl phosphate in a proportion of less than 0.04, based on vinyl chloride vinyl acetate copolymer resin resulted in relatively marked lowering in image density.

Example 5

Thermal transfer image receiving sheets 5-1 and 5-2 were prepared similarly to image receiving sheets 3-1 and 3-2 described in Example 3, respectively, except that 1.6 parts by weigh of magnesium oleate was added as a metal ion species different form a metal source. Then, after image receiving sheets 3-1 and 3-2 prepared in Example 3 and the foregoing image receiving sheets 5-1 and 5-2 were each aged for 3 weeks under an environment of 50° C. and 80% RH, using these aged image receiving sheets and ink sheet 1 prepared in Example 1, image recording was performed to form images 5-1 to 5-4. The print rate was 1.1 msec/line.

Subsequently, the thus formed images were each evaluated with respect to maximum density (DmaxC) and light fastness, similarly to Example 1, provided that the period of exposure in a xenon fadometer (70,000 lux) was varied to 3 weeks.

The thus obtained results are shown in Table 5.

TABLE 5

| Image No. | Image Receiving Sheet No. | Additive | Metal Ion Species | DmaxC | Light Fastness (%) |
|---|---|---|---|---|---|
| 5-1 | 3-1 | S-1 | — | 1.82 | 79 |
| 5-2 | 5-1 | S-1 | M-2 | 1.93 | 88 |
| 5-3 | 3-2 | S-2 | — | 1.82 | 78 |
| 5-4 | 5-2 | S-2 | M-2 | 1.93 | 87 |

As apparent from the results shown in Table 5, it was proved that the use of a metal ion species different from a metal source together with sorbitan monostearate or tricresyl phosphate in the image receiving sheet maintained high image densities, even when image formation was performed at a high-speed print condition of 1.1 msec/line or less after the image receiving sheet was aged over a long-term under severe conditions, specifically, superior light fastness was achieved even when the obtained images were further aged under further severe conditions.

What is claimed is:

1. An image forming method of a thermal transfer recording material comprising an ink sheet comprising, on a substrate sheet, an ink layer containing a thermally diffusible dye capable of forming a chelate with a metal, and an image receiving sheet comprising, on a substrate, a dye receiving layer containing a metal ion containing compound capable of forming a metal chelate compound upon reaction with the thermally diffusible dye, the method comprising the steps of:

(a) superimposing the ink layer onto the dye receiving layer, and (b) imagewise heating the ink sheet based on a recording signal to transfer the thermally diffusible dye from the ink sheet to the image receiving sheet, wherein the imagewise heating is performed at a print rate of not more than 1.5 msec/line, and the dye receiving layer further contains a metal ion species different from the metal ion containing compound or at least one compound selected from the group of a sorbitan fatty acid ester, a sorbitan fatty acid ester having a polyoxyethylene group, a phosphoric acid ester, a compound represented by the following formula (1) and a compound represented by the following formula (2):

$$HO—[CH_2CH_2O]_n—[CH_2CH(CH_3)O]_m—H \quad \text{formula (1)}$$

wherein n is an integer of 100 to 200; m is an integer of 10 to 50;

$$HO—(W—O)_p—H \quad \text{formula (2)}$$

wherein W is $—CH_2CH_2—$, $—CH_2CH_2CH_2—$, $—CH_2CH(CH_3)—$ or $—CH_2CH_2CH_2CH_2—$; and p is an integer of 5 to 50.

2. The method of claim 1, wherein the metal ion containing compound is represented by the following formula (A):

$$[M(Q_1)_x(Q_2)_y(Q_3)_z]^{p+}(L^-)_p \quad \text{formula (A)}$$

wherein M is a metal ion selected from the group of $Ni^{2+}$, $Cu^{2+}$, $Co^{2+}$ and $Zn^{2+}$; $Q_1$, $Q_2$ and $Q_3$ are each a compound capable of forming a coordination bond with the metal ion of M; $L^-$ is an organic anion; x is 1, 2 or 3, y is 0, 1 or 2, z is 0 or 1, and p is 1 or 2.

3. The method of claim 1, wherein the metal ion species is an organic metal compound containing at least a metal ion selected from the group of $Ni^{2+}$, $Cu_{2+}$, $Co^{2+}$, $Zn_{2+}$, $Mg_{2+}$ and $Al_{3+}$.

4. The method of claim 3, wherein the organic metal compound is an organic acid metal salt, a metal alkoxide or an organic metal complex having at least a coordination bond with an oxygen atom.

5. The method of claim 4, wherein the organic acid metal salt is a metal salt of a fatty acid.

6. The method of claim 4, wherein the organic metal complex is an acetylacetonatometal complex.

7. The method of claim 1, wherein the dye receiving layer contains the metal ion species and at least one compound selected from the group of a sorbitan fatty acid ester, a sorbitan fatty acid ester having a polyoxyethylene group, a phosphoric acid ester, a compound represented by formula (1) and a compound represented by formula (2).

8. An image forming method of a thermal transfer recording material comprising an ink sheet comprising, on a substrate sheet, an ink layer containing a thermally diffusible dye capable of forming a chelate with a metal, and an image receiving sheet comprising, on a substrate, a dye receiving layer containing a metal ion containing compound capable of forming a metal chelate compound upon reaction with the thermally diffusible dye, the method comprising the steps of:

(a) superimposing the ink layer onto the dye receiving layer, and (b) imagewise heating the ink sheet based on a recording signal to transfer the thermally diffusible dye from the ink sheet to the image receiving sheet, wherein the imagewise heating is performed at a print rate of not more than 1.5 msec/line, and the dye receiving layer further contains a metal ion species different from the metal ion containing compound.

9. The method of claim 8, wherein the metal ion containing compound is represented by the following formula (A):

$$[M(Q_1)_x(Q_2)_y(Q_3)_z]^{p+}(L^-)_p \qquad \text{formula (A)}$$

wherein M is a metal ion selected from the group of $Ni^{2+}$, $Cu^{2+}$, $Co^{2+}$ and $Zn^{2+}$; $Q_1$, $Q_2$ and $Q_3$ are each a compound capable of forming a coordination bond with the metal ion of M; $L^-$ is an organic anion; x is 1, 2 or 3, y is 0, 1 or 2, z is 0 or 1, and p is 1 or 2.

10. The method of claim 8, wherein the metal ion species is an organic metal compound containing at least a metal ion selected from the group of $Ni^{2+}$, $Cu^{2+}$, $Co^{2+}$, $Zn^{2+}$, $Mg^{2+}$ and $Al^{3+}$.

11. The method of claim 8, wherein a metal ion molar ratio of the metal ion containing compound to the metal ion species is from 1.00:0.20 to 1.00:0.02.

12. The method of claim 8, wherein the dye receiving layer further contains at least one compound selected from the group of a sorbitan fatty acid ester, a sorbitan fatty acid ester having a polyoxyethylene group, a phosphoric acid ester, a compound represented by the following formula (1) and a compound represented by the following formula (2):

$$HO—[CH_2CH_2O]_n—[CH_2CH(CH_3)O]_m—H \qquad \text{formula (1)}$$

wherein n is an integer of 100 to 200; m is an integer of 10 to 50;

$$HO—(W—O)_p—H \qquad \text{formula (2)}$$

wherein W is $—CH_2CH_2—$, $—CH_2CH_2CH_2—$, $—CH_2CH(CH_3)—$ or $—CH_2CH_2CH_2CH_2—$; and p is an integer of 5 to 50.

13. An image forming method of a thermal transfer recording material comprising an ink sheet comprising, on a substrate sheet, an ink layer containing a thermally diffusible dye capable of forming a chelate with a metal, and an image receiving sheet comprising, on a substrate, a dye receiving layer containing a metal ion containing compound capable of forming a metal chelate compound upon reaction with the thermally diffusible dye, the method comprising the steps of:

(a) superimposing the ink layer onto the dye receiving layer, and (b) imagewise heating the ink sheet based on a recording signal to transfer the thermally diffusible dye from the ink sheet to the image receiving sheet, wherein the imagewise heating is performed at a print rate of not more than 1.5 msec/line, and the dye receiving layer further contains at least one compound selected from the group of a sorbitan fatty acid ester, a sorbitan fatty acid ester having a polyoxyethylene group, a phosphoric acid ester, a compound represented by the following formula (1) and a compound represented by the following formula (2):

$$HO—[CH_2CH_2O]_n—[CH_2CH(CH_3)O]_m—H \qquad \text{formula (1)}$$

wherein n is an integer of 100 to 200; m 10 to 50;

$$HO—(W—O)_p—H \qquad \text{formula (2)}$$

wherein W is $—CH_2CH_2—$, $—CH_2CH_2CH_2—$, $—CH_2CH(CH_3)—$ or $—CH_2CH_2CH_2CH_2—$; and p is an integer of 5 to 50.

14. The method of claim 13, wherein the dye receiving layer further contains a binder resin and a weight ratio of the binder resin to at least one compound selected from the group of a sorbitan fatty acid ester, a sorbitan fatty acid ester having a polyoxyethylene group, a phosphoric acid ester, a compound represented by formula (1) and a compound represented by formula (2) is from 1.00:0.50 to 1.00:0.04.

* * * * *